US011827430B2

(12) United States Patent
Brink et al.

(10) Patent No.: US 11,827,430 B2
(45) Date of Patent: Nov. 28, 2023

(54) TRAY FOR FOOD PRODUCTS

(71) Applicant: Graphic Packaging International, LLC, Atlanta, GA (US)

(72) Inventors: Thomas Brink, Grand Rapids, MI (US); Elliot Hithersay, Derby (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/519,084

(22) Filed: Nov. 4, 2021

(65) Prior Publication Data

US 2022/0144476 A1 May 12, 2022

Related U.S. Application Data

(60) Provisional application No. 63/191,412, filed on May 21, 2021, provisional application No. 63/178,116,
(Continued)

(51) Int. Cl.
*B65D 5/42* (2006.01)
*B65D 85/50* (2006.01)
(Continued)

(52) U.S. Cl.
CPC ..... *B65D 5/4295* (2013.01); *B65D 5/2047* (2013.01); *B65D 5/248* (2013.01);
(Continued)

(58) Field of Classification Search
CPC .... B65D 5/4295; B65D 5/2047; B65D 5/248; B65D 5/4266; B65D 5/7279; B65D 5/443;
(Continued)

(56) References Cited

U.S. PATENT DOCUMENTS 622,921 A 4/1899 Fuller
667,634 A 2/1901 Schmidt
(Continued)

FOREIGN PATENT DOCUMENTS

DE 1810600 A1 7/1969
EP 0 270 838 6/1988
(Continued)

OTHER PUBLICATIONS

International Search Report and Written Opinion for PCT/US2021/058048 dated Feb. 18, 2022.
(Continued)

*Primary Examiner* — Christopher R Demeree
(74) *Attorney, Agent, or Firm* — WOMBLE BOND DICKINSON (US) LLP

(57) ABSTRACT

A tray for holding at least one food product includes a plurality of panels extending at least partially around an interior of the tray, the plurality of panels including a bottom panel, a front panel, a back panel, and at least one side panel, a plurality of end flaps foldably connected to a respective panel of the plurality of panels and cooperating to form a rim extending outwardly from the plurality of panels, and locking features comprising at least one male locking feature extending from at least one end flap of the plurality of end flaps, the at least one male locking feature at least partially inserted through at least one female locking feature in a respective panel of the plurality of panels to reinforce the rim.

44 Claims, 12 Drawing Sheets

Related U.S. Application Data filed on Apr. 22, 2021, provisional application No. 63/174,724, filed on Apr. 14, 2021, provisional application No. 63/169,302, filed on Apr. 1, 2021, provisional application No. 63/169,418, filed on Apr. 1, 2021, provisional application No. 63/139,341, filed on Jan. 20, 2021, provisional application No. 63/128,418, filed on Dec. 21, 2020, provisional application No. 63/126,157, filed on Dec. 16, 2020, provisional application No. 63/110,578, filed on Nov. 6, 2020, provisional application No. 63/110,587, filed on Nov. 6, 2020, provisional application No. 63/110,582, filed on Nov. 6, 2020.

(51) Int. Cl.
*B65D 5/24* (2006.01)
*B65D 5/20* (2006.01)
*B65D 5/44* (2006.01)
*B65D 21/02* (2006.01)

(52) U.S. Cl.
CPC ..... *B65D 5/4266* (2013.01); *B65D 5/4279* (2013.01); *B65D 5/443* (2013.01); *B65D 21/0233* (2013.01); *B65D 85/50* (2013.01)

(58) Field of Classification Search
CPC .... B65D 21/0233; B65D 85/50; B65D 5/563; B65D 77/2024; B65D 85/34; B65D 5/242; B65D 5/243; B65D 5/2033; B65D 5/246; B65D 5/247; B65D 5/241; B65D 5/244; B65D 5/5021
USPC ..... 229/174, 186, 170, 171, 109, 169, 114, 229/143, 151, 125.19, 125.35, 176, 177, 229/179; 206/518, 520; 426/106
See application file for complete search history.

(56) References Cited

U.S. PATENT DOCUMENTS 1,683,761 A 9/1928 Craig
1,894,209 A 1/1933 Wikstrom
1,999,461 A 4/1935 Kells
2,016,754 A 10/1935 Perkit
2,028,276 A 1/1936 Evans
2,037,502 A 4/1936 Cox
2,043,104 A 6/1936 Clancy
2,163,017 A * 6/1939 Berch ..... A61K 8/9789 229/905
2,232,088 A 2/1941 Waters
2,279,670 A 4/1942 Ford
2,321,848 A 6/1943 O'Reilly
2,740,576 A 4/1956 Franck
2,800,893 A 7/1957 Norman et al.
2,836,339 A 5/1958 Pringle
2,858,630 A 11/1958 Gorman
2,859,905 A 11/1958 Choate
2,944,721 A 7/1960 Choate
3,102,674 A 9/1963 Portola
3,116,866 A 1/1964 Frank
3,246,830 A 4/1966 Smith
3,276,660 A 10/1966 Vesak
3,300,117 A 1/1967 Kossnar
3,316,102 A 4/1967 Doll
3,355,085 A 11/1967 Olaf
3,366,306 A 1/1968 Kotowick
3,425,543 A 2/1969 Harvey
3,447,672 A 6/1969 Bailey et al.
3,478,950 A 11/1969 Stevens
3,515,331 A 6/1970 Guthrie, Sr.
3,516,594 A 6/1970 Stenzel
3,516,595 A 6/1970 Bailey
3,606,078 A 9/1971 Phillips, Jr.
3,630,430 A 12/1971 Struble
3,637,130 A 1/1972 Farquhar
3,715,853 A 2/1973 Bemiss
3,739,939 A 6/1973 Koenig
3,767,108 A 10/1973 Arneson
3,833,113 A 9/1974 Osier
3,845,897 A 11/1974 Buttery et al.
3,876,131 A 4/1975 Tolaas
3,877,632 A 4/1975 Steel
3,912,331 A 10/1975 Turner et al.
3,917,155 A 11/1975 Bemiss
3,927,823 A 12/1975 Persson
4,014,496 A 3/1977 Christensson
4,034,907 A 7/1977 Engdahl, Jr.
4,049,188 A 9/1977 Persson
4,054,241 A 10/1977 Meyers et al.
4,079,853 A 3/1978 Casutt
4,109,848 A 8/1978 Kipp et al.
4,124,160 A 11/1978 Meyers et al.
4,126,265 A 11/1978 Holmes
4,166,567 A 9/1979 Beach, Jr. et al.
4,185,764 A 1/1980 Cote
4,199,097 A 4/1980 Christensson
4,205,775 A 6/1980 Swan
4,227,640 A 10/1980 Roccaforte
4,244,472 A 1/1981 Brown
4,267,955 A 5/1981 Struble
4,277,506 A 7/1981 Austin
4,283,427 A 8/1981 Winters et al.
4,305,543 A 12/1981 Lai
4,362,266 A 12/1982 Webinger
4,410,129 A 10/1983 Wischusen, III
4,417,882 A 11/1983 Wallin
4,418,861 A 12/1983 McFarland et al.
4,432,489 A 2/1984 Cote
4,502,623 A 3/1985 Moore et al.
4,607,785 A 8/1986 Croley
4,648,549 A * 3/1987 Trutna ..... B65D 5/247 229/177
4,676,429 A 6/1987 Crowe et al.
D290,813 S 7/1987 Forbes, Jr.
4,682,727 A 7/1987 Stoll
4,718,596 A 1/1988 Muller
4,765,534 A 8/1988 Zion et al.
4,775,771 A 10/1988 Pawlowski et al.
4,792,084 A 12/1988 Dreeszen
4,801,774 A 1/1989 Hart
4,836,439 A 6/1989 Hart
4,846,398 A * 7/1989 Johnson ..... B65D 5/247 229/179
4,865,921 A 9/1989 Hollenberg et al.
4,871,111 A 10/1989 Mode
4,890,439 A 1/1990 Smart
4,901,911 A 2/1990 Drexhage
4,905,834 A 3/1990 Mur Gimeno et al.
4,915,235 A 4/1990 Roosa
4,919,267 A 4/1990 Stoll
4,936,935 A 6/1990 Beckett
4,943,456 A 7/1990 Pollart et al.
4,963,424 A 10/1990 Beckett
4,998,669 A * 3/1991 Karolyi ..... B65D 5/246 229/188
5,002,826 A 3/1991 Pollart et al.
5,039,364 A 8/1991 Beckett et al.
5,049,710 A 9/1991 Prosise et al.
5,077,455 A 12/1991 Peleg et al.
5,117,078 A 5/1992 Beckett
5,118,747 A 6/1992 Pollart et al.
5,211,330 A 5/1993 Frey
5,213,902 A 5/1993 Beckett
5,221,419 A 6/1993 Beckett
5,232,149 A 8/1993 Stoll
5,247,149 A 9/1993 Peleg
5,260,537 A 11/1993 Beckett
5,266,386 A 11/1993 Beckett
5,294,765 A 3/1994 Archibald et al.
5,326,021 A 7/1994 Farrell
RE34,683 E 8/1994 Maynard et al.
5,338,921 A 8/1994 Maheux et al.

(56) References Cited

U.S. PATENT DOCUMENTS 5,340,436 A 8/1994 Beckett
5,351,879 A 10/1994 Liu et al.
5,354,973 A 10/1994 Beckett
5,410,135 A 4/1995 Pollart et al.
5,412,187 A 5/1995 Walters et al.
5,424,517 A 6/1995 Habeger, Jr. et al.
5,519,195 A 5/1996 Keefer et al.
5,520,322 A 5/1996 Conviser
5,530,231 A 6/1996 Walters et al.
5,535,942 A 7/1996 Vilona
5,628,921 A 5/1997 Beckett
5,672,407 A 9/1997 Beckett
5,718,368 A 2/1998 Rench et al.
5,720,429 A 2/1998 Cordle
5,726,426 A 3/1998 Davis et al.
5,759,422 A 6/1998 Schmelzer et al.
5,762,225 A 6/1998 Byrd
5,800,724 A 9/1998 Habeger et al.
5,816,485 A 10/1998 Bernstein
5,948,308 A 9/1999 Wischusen, III
5,961,035 A 10/1999 Correll
6,019,276 A 2/2000 Auclair
6,050,482 A 4/2000 Cai
6,092,720 A * 7/2000 Karolyi ..... B65D 5/2047 229/169
6,102,281 A 8/2000 Lafferty et al.
6,114,679 A 9/2000 Lai et al.
6,137,099 A 10/2000 Hamblin
6,150,646 A 11/2000 Lai et al.
6,170,740 B1 1/2001 Clark
D437,557 S 2/2001 Ingelin et al.
6,182,890 B1 2/2001 Sattler et al.
6,204,492 B1 3/2001 Zeng et al.
6,251,451 B1 6/2001 Zeng
6,359,272 B1 3/2002 Sadek et al.
6,371,363 B1 4/2002 Franklin et al.
6,371,364 B1 4/2002 Maillot
6,414,290 B1 7/2002 Cole et al.
6,433,322 B2 8/2002 Zeng et al.
6,455,827 B2 9/2002 Zeng
6,513,704 B1 2/2003 Perot
6,552,315 B2 4/2003 Zeng et al.
6,561,414 B1 5/2003 Cai
6,588,652 B2 7/2003 Cai
6,677,563 B2 1/2004 Lai
6,717,121 B2 4/2004 Zeng et al.
6,719,190 B2 4/2004 Yocum
6,765,182 B2 7/2004 Cole et al.
6,808,105 B2 10/2004 Lee
7,007,838 B1 3/2006 Bostick, II
7,017,797 B2 3/2006 Goglio
7,019,271 B2 3/2006 Wnek et al.
7,140,532 B2 11/2006 Holt et al.
7,219,828 B2 5/2007 Lombardo
7,232,055 B1 6/2007 Lim
7,273,162 B2 9/2007 Baker
7,323,669 B2 1/2008 Robison et al.
7,328,833 B1 2/2008 Wiley
7,351,942 B2 4/2008 Wnek et al.
7,365,292 B2 4/2008 Cole et al.
7,473,875 B2 1/2009 Fitzwater
7,514,659 B2 4/2009 Lafferty
7,541,562 B2 6/2009 Cole et al.
D603,255 S * 11/2009 King ..... D9/433
7,648,031 B2 1/2010 Kari
7,648,059 B2 1/2010 Pavlu, Jr. et al.
7,667,167 B2 2/2010 Fitzwater
7,748,536 B2 7/2010 Cassese et al.
7,762,394 B2 7/2010 Bradford et al.
7,793,821 B2 9/2010 Oliveira
7,798,327 B1 9/2010 Berkani et al.
7,824,719 B2 11/2010 Cole et al.
7,870,995 B1 * 1/2011 Kaltman ..... B65D 5/68 229/175
7,893,389 B2 2/2011 Fitzwater
7,975,871 B2 7/2011 Wnek et al.
7,982,167 B2 7/2011 Fitzwater
7,982,349 B2 7/2011 Popov et al.
8,013,280 B2 9/2011 Robison et al.
8,063,344 B2 11/2011 Cole et al.
8,087,570 B2 1/2012 Ho Fung
8,106,339 B2 1/2012 Robbins et al.
8,158,914 B2 4/2012 Wnek et al.
8,183,506 B2 5/2012 Fitzwater
8,186,570 B2 5/2012 Learn
8,252,217 B2 8/2012 Wnek et al.
8,309,896 B2 11/2012 Fitzwater
8,492,690 B1 7/2013 Watkins
8,534,536 B2 9/2013 Mueller et al.
8,567,661 B2 10/2013 Sullivan
9,078,296 B2 7/2015 Fitzwater
9,113,648 B2 8/2015 Burke
9,402,491 B1 8/2016 Debernardi
10,232,973 B2 3/2019 Burke
10,336,500 B2 7/2019 Burke
11,345,508 B2 5/2022 Wisecarver
11,370,576 B1 6/2022 Bevier
2001/0032843 A1 10/2001 Aronsson et al.
2002/0084319 A1 7/2002 Yocum
2003/0006273 A1 1/2003 Tsern et al.
2003/0226881 A1 12/2003 Liou
2004/0232034 A1 11/2004 Lebras
2004/0234653 A1 11/2004 Cogley et al.
2004/0238534 A1 12/2004 Mast
2005/0082355 A1 4/2005 Beutler
2005/0184066 A1 8/2005 Brooks et al.
2005/0194286 A1 9/2005 Ilyayeva et al.
2005/0205565 A1 9/2005 Cole et al.
2006/0006215 A1 1/2006 Chen
2006/0049190 A1 3/2006 Middleton et al.
2006/0096978 A1 5/2006 Lafferty et al.
2006/0113300 A1 6/2006 Wnek et al.
2006/0180644 A1 8/2006 Baker
2006/0278521 A1 12/2006 Stowell
2007/0056962 A1 3/2007 Hopkins, Sr. et al.
2007/0102424 A1 5/2007 Keefe
2007/0131744 A1 6/2007 Fitzwater
2007/0131745 A1 6/2007 Fitzwater
2007/0215611 A1 9/2007 O'Hagan et al.
2007/0251942 A1 11/2007 Cole et al.
2007/0251943 A1 11/2007 Wnek et al.
2007/0262487 A1 11/2007 O'Hagan et al.
2007/0275130 A1 11/2007 Cole et al.
2008/0000897 A1 1/2008 Robbins et al.
2008/0023469 A1 1/2008 Fitzwater
2008/0035634 A1 2/2008 Zeng et al.
2008/0047958 A1 2/2008 Cole et al.
2008/0078759 A1 4/2008 Wnek et al.
2008/0081095 A1 4/2008 Cole et al.
2008/0110966 A1 5/2008 Yocum
2009/0072015 A1 3/2009 Drew et al.
2009/0090708 A1 4/2009 Requena et al.
2009/0218338 A1 9/2009 Futzwater
2010/0025393 A1 2/2010 Talpaert
2010/0038359 A1 2/2010 Laubhan et al.
2010/0051675 A1 3/2010 Sweet
2010/0065556 A1 3/2010 Cole
2010/0065621 A1 3/2010 Quaintance
2010/0072197 A1 3/2010 Neff et al.
2010/0102111 A1 4/2010 Learn
2010/0122999 A1 5/2010 Brand
2010/0193509 A1 8/2010 Fitzwater
2010/0264135 A1 10/2010 Cole
2011/0024413 A1 2/2011 Cole
2011/0089227 A1 4/2011 Kaltman et al.
2011/0114715 A1 5/2011 House
2011/0132903 A1 6/2011 Cole
2011/0233266 A1 9/2011 Pezzoli
2012/0228370 A1 9/2012 Faulon et al.
2013/0087607 A1 4/2013 Learn
2013/0299566 A1 11/2013 Sylvester
2014/0374953 A1 12/2014 Middleton

(56) References Cited

U.S. PATENT DOCUMENTS

| | | | |
|---|---|---|---|
| 2015/0375468 | A1 | 12/2015 | Wnek |
| 2021/0053714 | A1 | 2/2021 | Zwaga |
| 2022/0048672 | A1 | 2/2022 | Bevier |

FOREIGN PATENT DOCUMENTS

| | | | |
|---|---|---|---|
| EP | 0 270 551 | B1 | 7/1990 |
| EP | 0 392 227 | B1 | 2/1993 |
| EP | 1 481 922 | | 12/2004 |
| EP | 1 364 558 | | 3/2005 |
| EP | 2 240 385 | | 6/2008 |
| EP | 2 605 974 | | 3/2014 |
| EP | 2 974 973 | | 1/2016 |
| FR | 2 867 346 | | 9/2005 |
| GB | 2 042 474 | A | 9/1980 |
| GB | 2 137 170 | A | 10/1984 |
| GB | 2 234 958 | A | 2/1991 |
| GB | 2 479 703 | A | 10/2011 |
| JP | 53-161938 | U | 12/1978 |
| JP | 4-253670 | | 9/1992 |
| JP | 6-293334 | | 10/1994 |
| JP | 7-040968 | | 2/1995 |
| JP | 2000-255546 | A | 9/2000 |
| JP | 2001-247122 | | 2/2001 |
| JP | 2001-080628 | A | 3/2001 |
| JP | 2011-006071 | | 1/2011 |
| JP | 2018-047939 | A | 3/2018 |
| KR | 20-0184133 | Y1 | 6/2000 |
| KR | 10-1363935 | | 2/2014 |
| KR | 10-1494078 | B1 | 2/2015 |
| KR | 10-2019-0053053 | A | 5/2019 |
| WO | WO 94/05563 | | 3/1994 |
| WO | WO 02/060223 | | 8/2002 |
| WO | WO 03/066435 | | 8/2003 |
| WO | WO 2005/077783 | | 8/2005 |
| WO | WO 2006/076501 | | 7/2006 |
| WO | WO 2007/127235 | | 11/2007 |
| WO | WO 2007/127371 | | 11/2007 |
| WO | WO 2007/133659 | | 11/2007 |
| WO | WO 2007/136839 | | 11/2007 |
| WO | WO 2009/006096 | | 1/2009 |
| WO | WO 2012/024206 | | 2/2012 |
| WO | WO 2019/092323 | A1 | 5/2019 |
| WO | WO 2019/179930 | A1 | 9/2019 |

OTHER PUBLICATIONS

International Search Report and Written Opinion for PCT/US2021/058043 dated Feb. 18, 2022.
International Search Report and Written Opinion for PCT/US2021/058050 dated Feb. 22, 2022.
International Search Report and Written Opinion for PCT/US2021/058051 dated Feb. 17, 2022.
International Search Report and Written Opinion for PCT/US2021/058049 dated Feb. 22, 2022.
U.S. Appl. No. 17/519,080, filed Nov. 4, 2021.
U.S. Appl. No. 29/785,893, filed May 27, 2021.
U.S. Appl. No. 29/785,899, filed May 27, 2021.
U.S. Appl. No. 17/519,092, filed Nov. 4, 2021.
U.S. Appl. No. 29/785,900, filed May 27, 2021.
U.S. Appl. No. 17/519,097, filed Nov. 4, 2021.
U.S. Appl. No. 29/785,905, filed May 27, 2021.
U.S. Appl. No. 17/519,107, filed Nov. 4, 2021.
U.S. Appl. No. 29/785,902, filed May 27, 2021.
U.S. Appl. No. 29/785,897, filed May 27, 2021.
U.S. Appl. No. 29/785,904, filed May 27, 2021.
U.S. Appl. No. 29/785,895, filed May 27, 2021.
U.S. Appl. No. 29/785,896, filed May 27, 2021.

* cited by examiner

TRAY FOR FOOD PRODUCTS

CROSS-REFERENCE TO RELATED APPLICATIONS

The present application claims the benefit of each of U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, and U.S. Provisional Patent Application No. 63/191,412, filed on May 21, 2021.

INCORPORATION BY REFERENCE

The disclosures of each of U.S. Provisional Patent Application No. 63/110,578, filed on Nov. 6, 2020, U.S. Provisional Patent Application No. 63/110,582, filed on Nov. 6, 2020, U.S. Provisional Patent Application No. 63/110,587, filed on Nov. 6, 2020, U.S. Provisional Patent Application No. 63/126,157, filed on Dec. 16, 2020, U.S. Provisional Patent Application No. 63/128,418, filed on Dec. 21, 2020, U.S. Provisional Patent Application No. 63/139,341, filed on Jan. 20, 2021, U.S. Provisional Patent Application No. 63/169,302, filed on Apr. 1, 2021, U.S. Provisional Patent Application No. 63/169,418, filed on Apr. 1, 2021, U.S. Provisional Patent Application No. 63/174,724, filed on Apr. 14, 2021, U.S. Provisional Patent Application No. 63/178,116, filed on Apr. 22, 2021, and U.S. Provisional Patent Application No. 63/191,412, filed on May 21, 2021, are hereby incorporated by reference for all purposes as if presented herein in their entirety.

BACKGROUND OF THE DISCLOSURE

The present disclosure generally relates to trays for holding at least one food product.

SUMMARY OF THE DISCLOSURE

According to one aspect, the disclosure is generally directed to a tray for holding at least one food product, the tray comprising a plurality of panels extending at least partially around an interior of the tray, the plurality of panels comprising a bottom panel, a front panel, a back panel, and at least one side panel, a plurality of end flaps foldably connected to a respective panel of the plurality of panels and cooperating to form a rim extending outwardly from the plurality of panels, and locking features comprising at least one male locking feature extending from at least one end flap of the plurality of end flaps, the at least one male locking feature at least partially inserted through at least one female locking feature in a respective panel of the plurality of panels to reinforce the rim.

According to another aspect, the disclosure is generally directed to a blank for forming a tray for holding at least one food product, the blank comprising a plurality of panels comprising a bottom panel, a front panel, a back panel, and at least one side panel, a plurality of end flaps foldably connected to a respective panel of the plurality of panels for cooperating to form a rim extending outwardly from the plurality of panels when the tray is formed from the blank, and locking features comprising at least one male locking feature extending from at least one end flap of the plurality of end flaps, the at least one male locking feature for being at least partially inserted through at least one female locking feature in a respective panel of the plurality of panels to reinforce the rim when the tray is formed from the blank.

According to another aspect, the disclosure is generally directed to a method of forming a tray for holding at least one food product, the method comprising obtaining a blank comprising a plurality of panels comprising a bottom panel, a front panel, a back panel, and at least one side panel, the blank further comprising a plurality of end flaps foldably connected to a respective panel of the plurality of panels, the blank further comprising locking features comprising at least one male locking feature extending from at least one end flap of the plurality of end flaps and at least one female locking feature in a respective panel of the plurality of panels. The method further comprises folding the plurality of panels at least partially around an interior of the tray, positioning the plurality of end flaps to form a rim extending outwardly from the plurality of panels, and inserting the at least one male locking feature at least through the at least one female locking feature to reinforce the rim.

Those skilled in the art will appreciate the above-stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Trays according to the present disclosure can accommodate articles of numerous different shapes. For the purpose of illustration and not for the purpose of limiting the scope of the disclosure, the following detailed description describes articles such as food products, e.g., fruit or vegetable items. In one embodiment, articles described herein can be fruits such as tomatoes (e.g., cherry tomatoes, etc.), berries (e.g., blueberries, raspberries, blackberries, strawberries, etc.), apples, oranges, tangerines, clementines, lemons, limes, cherries, etc. In another embodiment, articles described herein can be product packages, containers, bottles, cans, etc., that are at least partially disposed within the tray embodiments. The articles can be used for packaging food and beverage products, for example. Packaged articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; composite materials; and the like, or any combination thereof.

The articles described herein can include different types of food or beverage products, containers thereof, and/or having different shapes, without departing from the disclosure. In this specification, the terms "lower," "bottom," "upper," and "top" indicate orientations determined in relation to fully erected and upright trays. As described herein, trays can be formed from blanks by overlapping multiple panels, portions, and/or end flaps. Such panels, portions and/or end flaps may be designated herein in terms relative to one another, e.g., "first", "second", "third", etc., in sequential or non-sequential reference, without departing from the disclosure.

Figure 1:
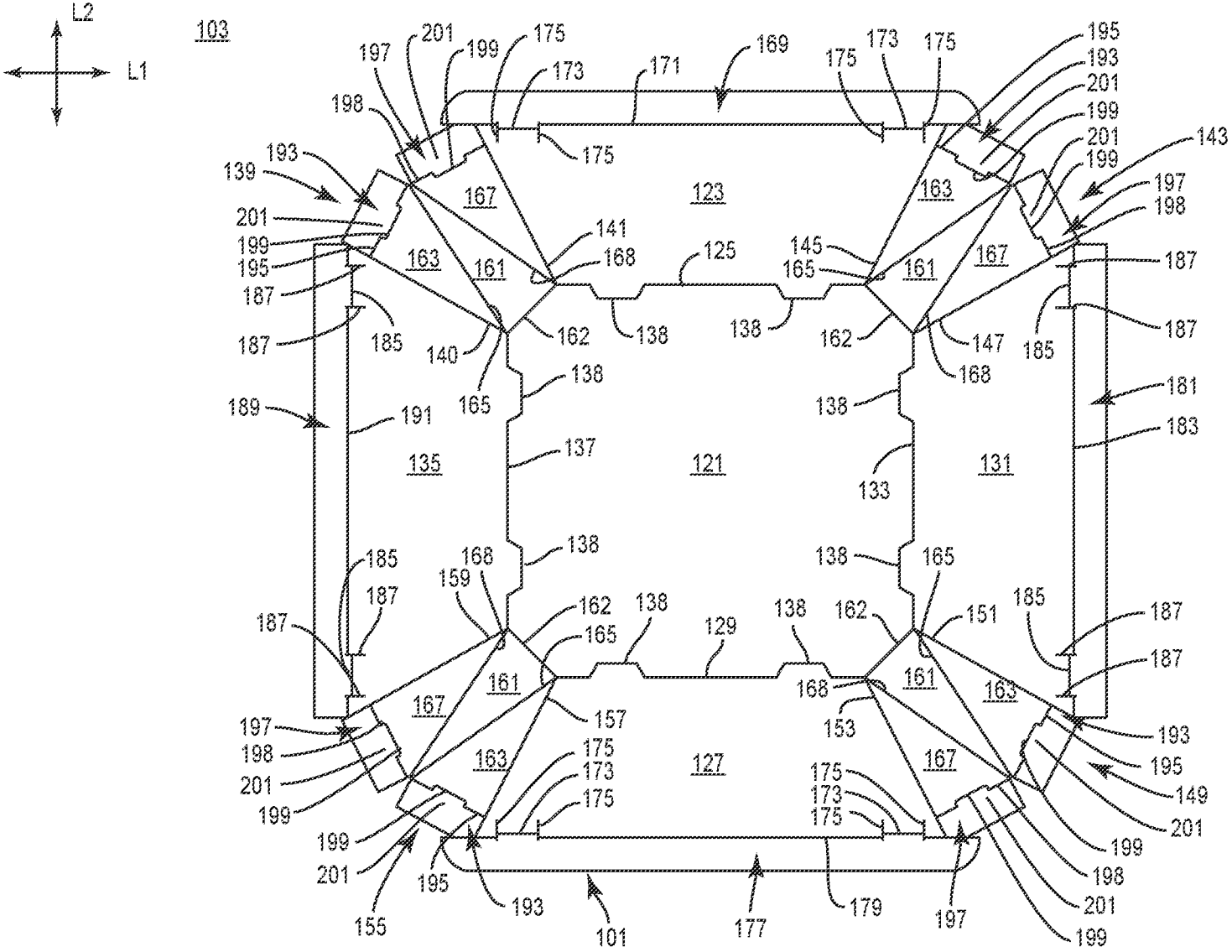
FIG. 1 is a plan view of an exterior surface of a blank used to form a tray according to a first exemplary embodiment of the disclosure.

FIG. 1 is a plan view of an exterior surface 101 of a blank, generally indicated at 103, used to form a tray 105 (FIG. 2) according to a first exemplary embodiment of the disclosure. While the constructs formed from the blanks disclosed herein are described as trays, it will be understood that such constructs can be considered cartons, containers, other constructs, etc., without departing from the disclosure.

As described further herein, the blank 103 includes engagement features for forming engagement features of the tray 105 that provide one or more surfaces for engaging a machine element or other component of a system associated with the formation, loading, and/or packaging of the tray 105. In addition, the engagement features of the blank 103/tray 105 provide one or more surfaces for receiving a lidding film F (FIG. 4), e.g., a polymeric film or other cover overlying the tray 105 to maintain one or more conditions of food products held therein. The engagement features of the tray 105 can also be arranged so as to maintain a structural integrity, e.g., rigidity/resistance to deformation, of the tray 105.

As shown, the blank 103 has a longitudinal axis L1 and a lateral axis L2 and includes a plurality of panels for extending at least partially around an interior 107 of the tray 105 when the tray 105 is formed from the blank 103. The panels can include a bottom panel 121, a front panel 123 foldably connected to the bottom panel 121 at a longitudinal fold line 125, a back panel 127 foldably connected to the bottom panel 121 at a longitudinal fold line 129, a first side panel 131 foldably connected to the bottom panel 121 at a lateral fold line 133, and a second side panel 135 foldably connected to the bottom panel 121 at a lateral fold line 137. As shown, each fold line can be at least partially interrupted by a pair of spaced apart cuts 138 having one or more of straight, angled, and/or curved portions.

The blank 103 can also include a plurality of end flaps/corner panels/corner flaps foldably connected to respective panels of the plurality of panels of the blank 103. In the illustrated embodiment, the corner panels can include, in clockwise relation, a first corner panel 139 foldably connected to each of the second side panel 135 and the front panel 123 at respective oblique fold lines 140, 141, a second corner panel 143 foldably connected to each of the front panel 123 and the first side panel 131 at respective oblique fold lines 145, 147, a third corner panel 149 foldably connected to each of the first side panel 131 and the back panel 127 at respective oblique fold lines 151, 153, and a fourth corner panel 155 foldably connected to each of the back side panel 127 and the second side panel 135 at respective oblique fold lines 157, 159.

Each corner panel, as shown, can include a central section 161 foldably connected to the bottom panel 121 at an oblique fold line 162, a first locking section 163 foldably connected to the central section 161 at an oblique fold line 165, and a second locking section 167 foldably connected to the central locking section 161 at an oblique fold line 168.

The blank 103/tray 105 can also include a plurality of end flaps foldably connected to respective panels of the plurality of panels. A front top end flap 169 can be foldably connected to the front panel 123 at a longitudinal fold line 171 at least partially interrupted by a longitudinally spaced pair of longitudinal cuts 173 (broadly, "second cut" or "first cut"). As shown, the endpoints of each cut 173 can be intersected by respective lateral cuts 175 or other lines of weakening.

Similarly, a back top end flap 177 can be foldably connected to the back panel 127 at a longitudinal fold line 179 interrupted by a longitudinally spaced pair of the cuts 173 having endpoints intersected by the lateral cuts 175. As shown, the cuts 173 can be at least partially formed in the panels 123, 127, though one or more of the cuts 173 could be at least partially formed in the end flaps 169, 177 without departing from the disclosure.

A first side top end flap 181 can be foldably connected to the first side panel 131 at a lateral fold line 183 interrupted by a laterally spaced pair of lateral cuts 185 (broadly, "first cut" or "second cut"), with longitudinal cuts 187 or other lines of weakening intersecting endpoints of the respective cuts 185. Similarly, a second side top end flap 189 can be foldably connected to the second side panel 135 at a lateral fold line 191 at least partially interrupted by a laterally spaced pair of the cuts 185 having endpoints intersected by the cuts 187. As shown, the cuts 185 can be at least partially formed in the panels 131, 135, though one or more of the cuts 185 could be at least partially formed in the end flaps 181, 189 without departing from the disclosure.

As also shown, a first corner section top end flap 193 can be foldably connected to the respective first locking sections 163 of the respective corner panels 139, 143, 149, 155 at respective oblique fold lines 195, and a second corner section top end flap 197 can be foldably connected to the respective second locking sections 167 of the respective corner panels 139, 143, 149, 155 at respective oblique fold lines 198. Each of the fold lines 195, 197 can be at least partially interrupted by a respective oblique cut 199 having one or more of curved, straight, and/or angled portions so as to define a locking tab 201 (broadly, "male locking features", "first tab" or "second tab") extending/protruding from the respective end flaps 193, 197.

As described further herein, the tabs 201 are for at least partially being inserted through the respective arrangements of cuts 173, 175 and cuts 185, 187 to facilitate and maintain a structural integrity, e.g., rigidity of the tray 105, and can at least partially form engagement features of the tray 105. In this regard, the tabs 201 and associated features as well as the cuts 173, 175, 185, 187 can form locking features of the tray 105, together or in various subcombinations, with the tabs 201 forming male locking features of the tray 105 and one or more of the cuts 173, 175, 185, 187 forming female locking features of the tray 105.

In one embodiment, the blank 103 can also include product visibility features for forming product visibility features of the tray 105, for example, one or more cuts, openings, etc., that can provide a customer with line-of-sight passages into the interior 107 of the tray 105, for example, to inspect food products held therein.

Figure 2:
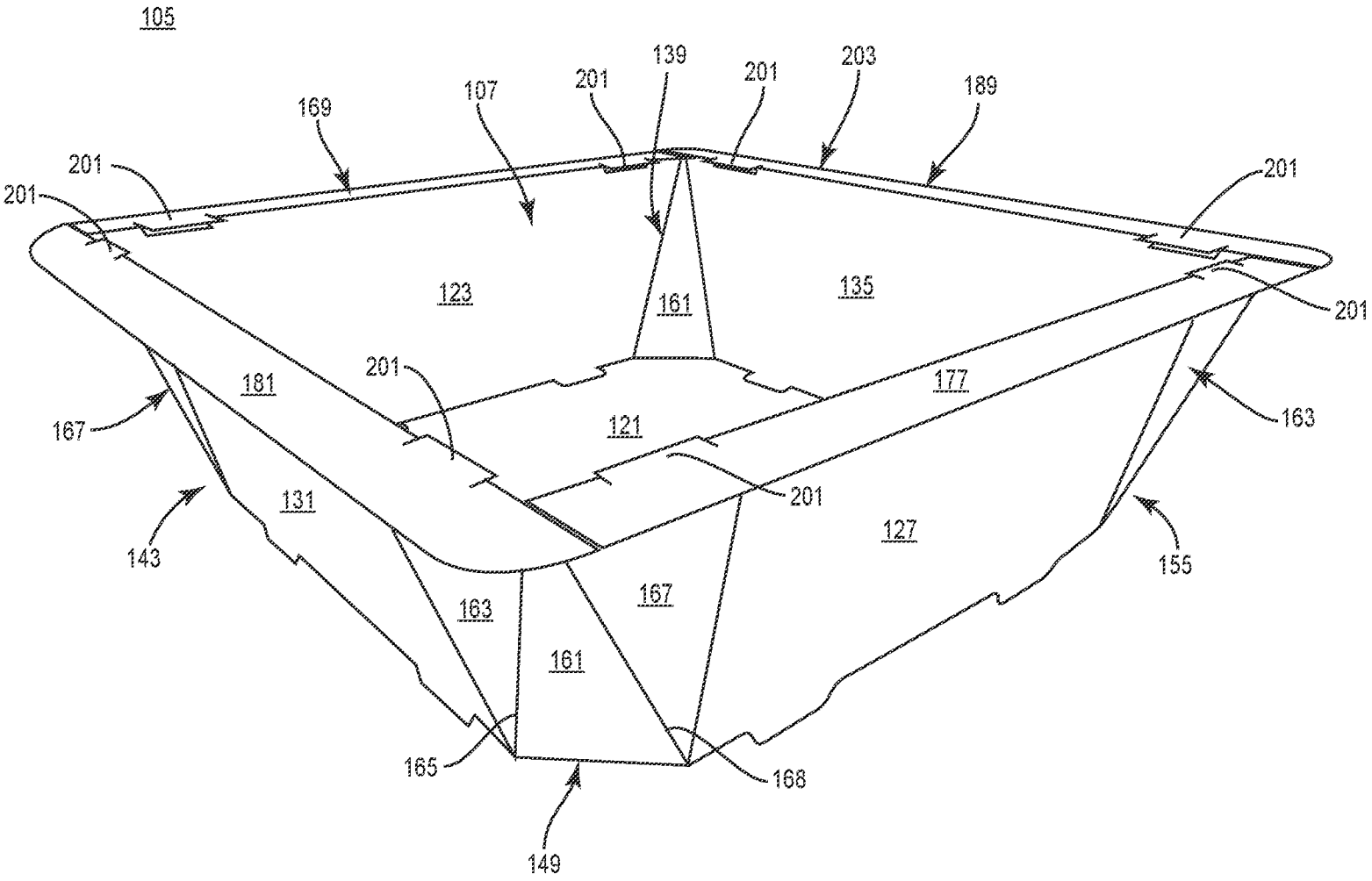
FIG. 2 is a perspective view of a tray formed from the blank of FIG. 1 according to the first exemplary embodiment of the disclosure.
Figure 3:
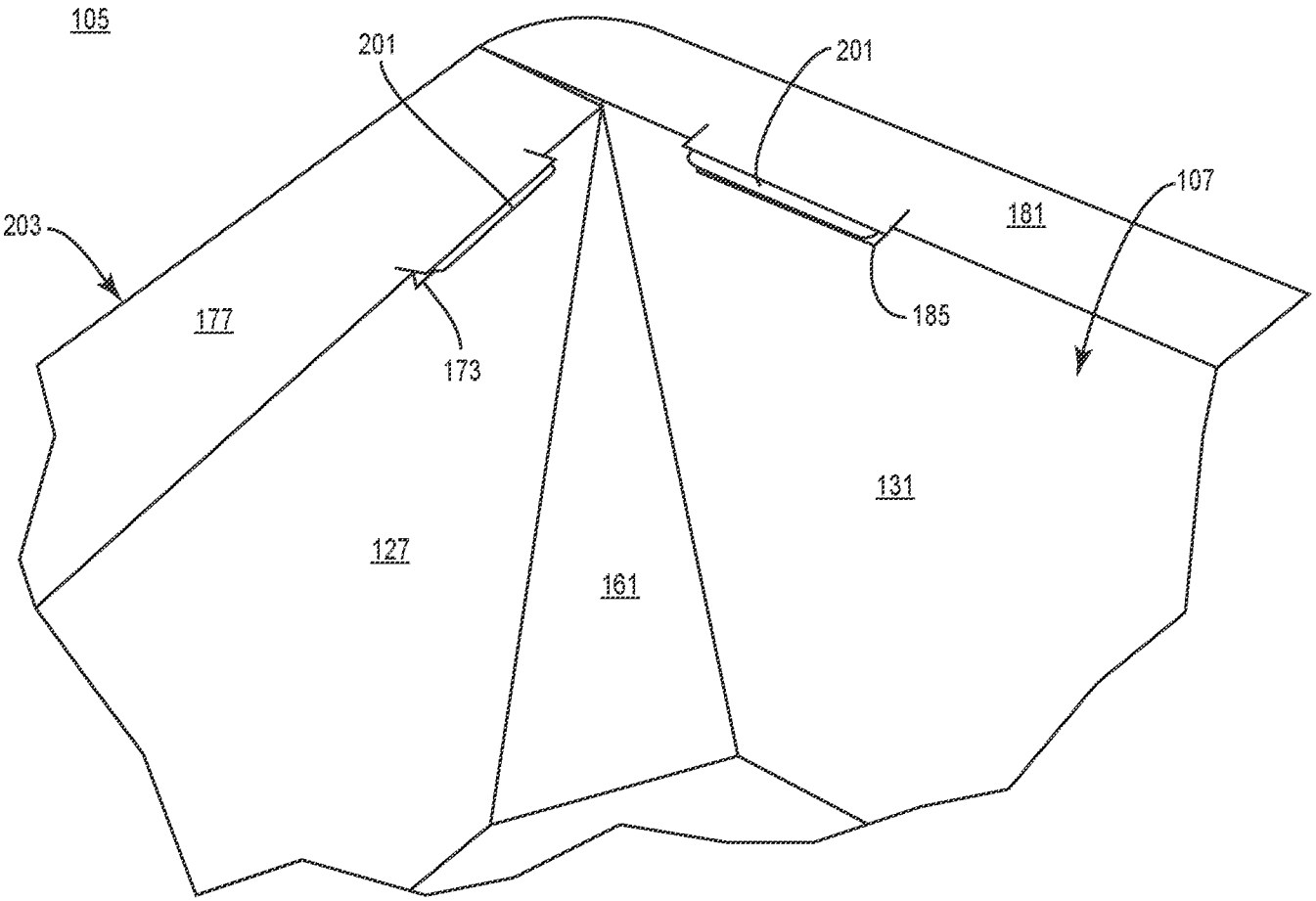
FIG. 3 is an enlarged view of a portion of the tray of FIG. 2.

Turning to FIGS. 2 and 3, according to one embodiment of the disclosure, formation of the tray 105 from the blank 103 can be performed by inverting the blank 103 such that the exterior surface 101 is positioned on a supporting surface and such that an interior surface of the blank 103 can be positioned facing upwardly.

The front panel 123, the back panel 127, the first side panel 131, and the second side panel 135 can be folded upwardly relative to the bottom panel 121 at the respective fold lines 125, 129, 133, 137. In one embodiment, such movement of the panels 123, 127, 131, 135 can cause downwardly protruding portions thereof to separate from the bottom panel 121 at the respective cuts 138 to form downwardly extending legs or extensions. Such movement of the panels 123, 137, 131, 135 can also cause the central section 161 of the respective corner panels 139, 143, 149, 155 to fold upwardly relative to the bottom panel 121 at the respective fold lines 162.

The first locking section 163 of the corner panel 139 can be folded at the fold line 140 into at least partial face-to-face contact with the second side panel 135 and the second locking section 167 of the corner panel 139 can be folded at the fold line 141 into at least partial face-to-face contact with the front panel 123. Such movement of the locking sections 163, 167 of the corner panel 139 can cause the second side panel 135 and the front panel 123 to approximate or draw together via folding of the locking sections 163, 167 relative to the central section 161 at the respective fold lines 165, 168.

The corner panels 143, 149, and 155 can be folded in a similar manner as described above with regard to the corner panel 139, with the respective first locking section 163 folded at the fold line 145 into at least partial face-to-face contact with the front panel 123 and the respective second locking section 167 folded at the fold line 147 into at least partial face-to-face contact with the first side panel 131, the respective first locking section 163 folded at the fold line 151 into at least partial face-to-face contact with the first side panel 131 and the respective second locking section 167 folded at the fold line 153 into at least partial face-to-face contact with the back panel 127, and the respective first locking section 163 folded at the fold line 157 into at least partial face-to-face contact with the back panel 127 and the respective second locking section 167 folded at the fold line 159 into at least partial face-to-face contact with the second side panel 135.

In the above-described arrangement, the respective corner top end flaps 193, 197 are carried into at least partial face-to-face contact with respective portions of the panel top end flaps 169, 177, 181, 189. In this regard, the tabs 201 extending from the respective top end flaps 193, 197 of the respective corner panels 139, 143, 149, 155 can be positioned in general alignment with the respective cuts 173, 175 and cuts 185, 187.

Simultaneously or thereafter, the front top end flap 169 can be folded downwardly at the fold line 171 to extend outwardly from the front panel 123, e.g., in a generally horizontal orientation parallel to the bottom panel 121. Such movement of the top end flap 169 can cause the respective top end flaps 193, 197 overlapped thereon to also fold downwardly at the respective fold lines 195, 198.

Similarly, the back top end flap 177 can be folded downwardly at the fold line 179 to extend outwardly from the back panel 127, the first side top end flap 181 can be folded downwardly at the fold line 183 to extend outwardly from the first side panel 131, and the second side top end flap 189 can be folded downwardly at the fold line 191 to extend outwardly from the second side panel 135, with respective top end flaps 193, 197 overlapped thereon to also fold downwardly at the respective fold lines 195, 198.

As described above, the tabs 201 extending from the respective top end flaps 193, 197 of the respective corner panels 139, 143, 149, 155 can be positioned in general alignment with the respective cuts 173, 175 and cuts 185, 187 so as to be at least partially inserted therethrough upon formation of the tray 105 to secure or lock the tray 105 in the aforementioned arrangement, e.g., obviating any need for further adhesive/glue to provide such secure engagement between the panels and flaps of the tray 105. In one embodiment, the tabs 201 can be inserted through the respective cuts 173, 175 and cuts 185, 187 in the course of the aforementioned folding steps.

It will be understood that one or more of the top end flaps 169, 177, 181, 189, 193, 197 can be manipulated, e.g., bent, urged, at least partially folded, flexed, etc., to facilitate such insertion of the tabs 201 through the respective cuts 173, 175 and cuts 185, 187, for example, manually by an operator and/or by a machine component of an apparatus for forming the tray 105.

In the illustrated embodiment of the tray 105, the panels 123, 127, 131, 135 can extend generally upwardly and obliquely outwardly from the bottom panel 121 such that the tray 105 has a generally tapered configuration, e.g., such that a top opening defined by the upper edges of the panels 123, 127, 131, 135 is larger than the bottom panel 121.

Figure 4:
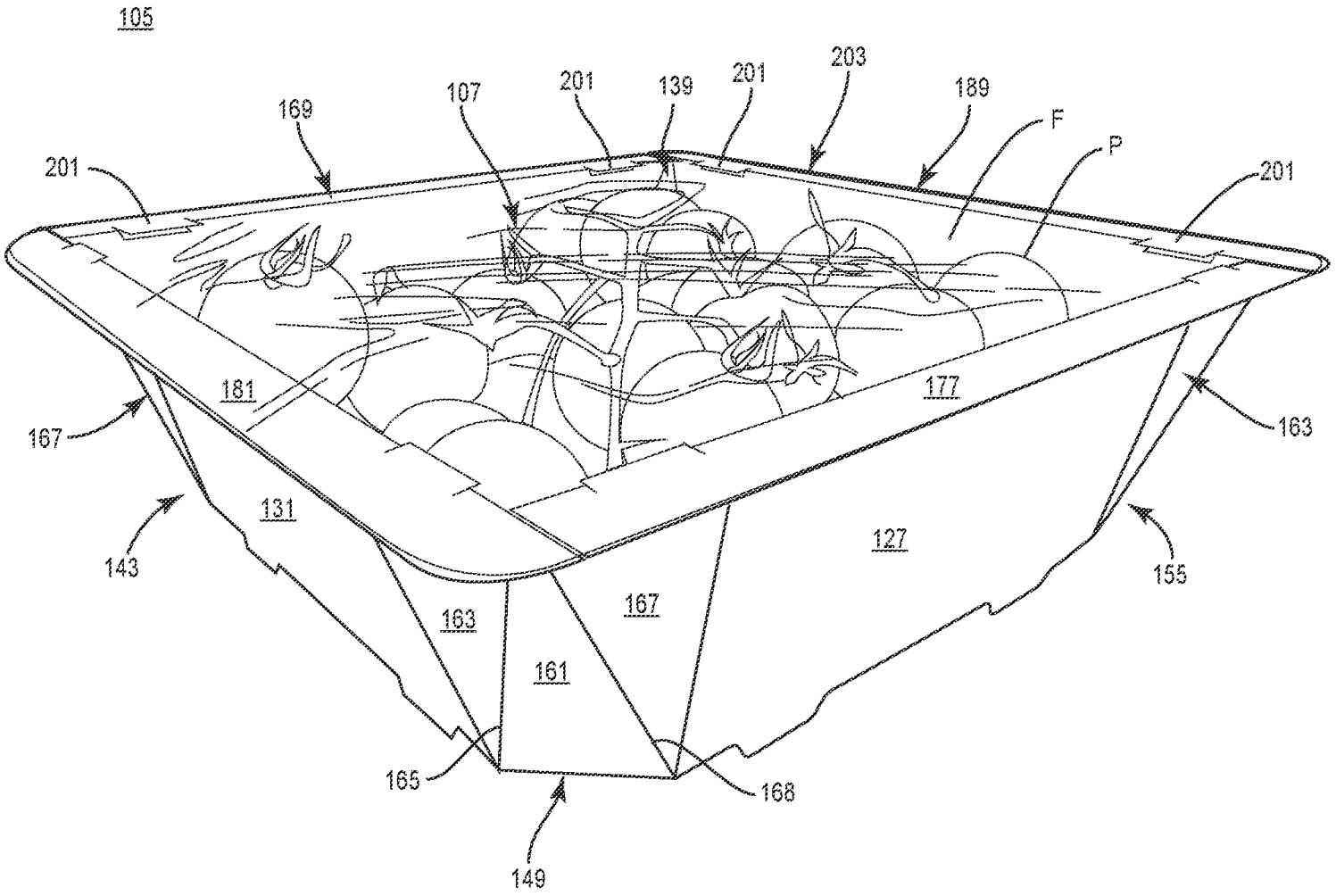
FIG. 4 is a perspective view of the tray of FIG. 2 holding food products and covered with a lidding film.

With additional reference to FIG. 4, it will be understood that one or more food products P can be dropped, placed, or otherwise positioned in the interior 107 of the tray 105 during or subsequent to the aforementioned steps. In one embodiment, the food products P can be tomatoes, though one or more of the food products can be a different food product without departing from the disclosure.

Engagement features of the tray 105 can include the arrangement of the top end flaps 169, 177, 181, 189, 193, 197, together or in subcombinations. As shown, the folded arrangement of the top end flaps 169, 177, 181, 189, 193, 197 extending outwardly from the respective panels forms a rim 203 and one or more engagement surfaces for being engaged/supported by an element associated with a forming apparatus for the tray 105, for example a machine element such as a grasper, fork, pincer, rail, etc. In one embodiment, the exterior (e.g., downward facing) surface of the top end flaps can present engagement surfaces for being engaged/supported by such a machine component. In other embodiments, engagement surfaces can include any combination of one or more of the exterior, interior (e.g., upward facing), and/or side-facing surfaces of one or more of the top end flaps 169, 177, 181, 189, 193, 197.

The positioning of the top end flaps 169, 177, 181, 189, 193, 197 extending away from the panels of the tray 105, also presents a plurality of engagement/support surfaces for engaging/supporting a lidding film F, e.g., a plastic or other polymeric film, or other covering structure. In one embodiment, the lidding film F can be provided as a polymeric layer that at least partially deforms in the presence of a heat source, e.g., a heat sealable film. The lidding film F can thus be positioned extending across a top opening of the tray 105 in contact with one or more surfaces of one or more of the top end flaps 169, 177, 181, 189, 193, 197 to cover the interior 107 of the tray 105 and maintain one or more conditions of the food products held therein, e.g., freshness, ripeness, moisture content, etc. It will be understood that the lidding film F can minimize, inhibit, and/or prevent the passage of one or more materials into the interior 107 of the tray 105, for example, condensation or other moisture, insects or other pests, dirt, debris, etc. In one embodiment, the tray 105 can be provided together with the lidding film F and one or more food products P as a package.

Furthermore, the engagement of the tabs 201 through the respective cuts 173, 175 and cuts 185, 187 provides binding and/or reinforcement of a structural integrity/rigidity of the arrangement of the top end flaps 169, 177, 181, 189, 193, 197/the rim 203, as well as the tray 105 as a whole. For example, the enhanced rigidity provided to the arrangement of the top end flaps 169, 177, 181, 189, 193, 197 via engagement of the engagement of the tabs 201 through the respective cuts 173, 175 and cuts 185, 187 can minimize, inhibit, and/or prevent bending, bowing, flexing, buckling, curling, other deformation, etc. of the rim 203. In this regard, forces exerted on the rim 203 via tension applied through a lidding film disposed thereon can minimize, inhibit, and/or prevent deformation of the rim 203, e.g., to avoid undesirable product aesthetics, to avoid at least partial disengagement of the lidding film with the rim 203, to maintain a generally planar configuration of the rim 203 for stacking, storage, transport, etc.

Figure 5:
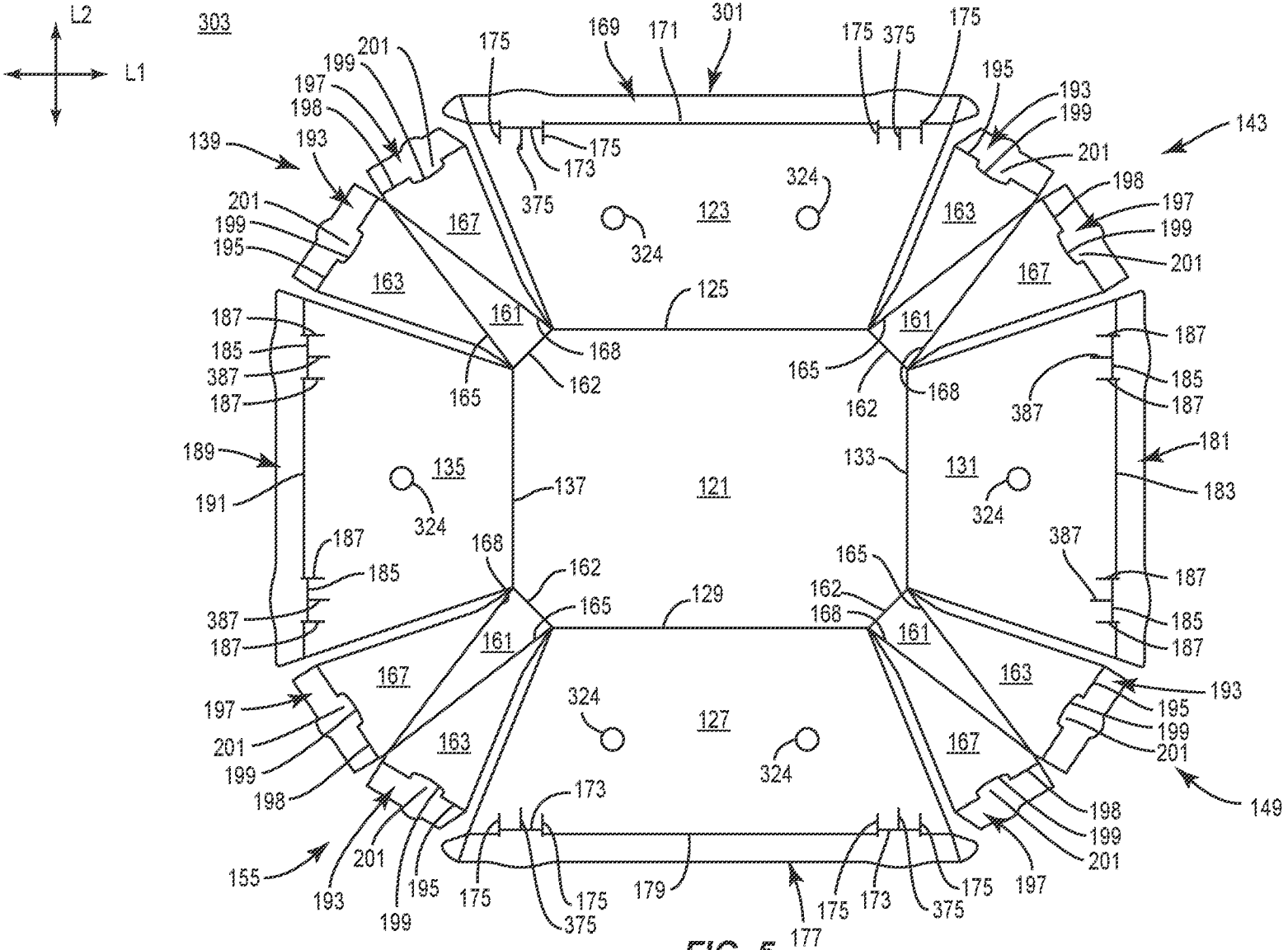
FIG. 5 is a plan view of an exterior surface of a blank used to form a tray according to a second exemplary embodiment of the disclosure.

Turning to FIG. 5, an exterior surface 301 of a blank 303 for forming a tray 305 (FIG. 6) according to a second exemplary embodiment of this disclosure is illustrated. The blank 303 and tray 305 can have one or more features similar to those of the blank 103 and tray 105 described above, and like or similar features are designated with like or similar reference numerals.

As shown, the blank 303 can have the longitudinal axis L1 and the longitudinal axis L2 and include the bottom panel 121, the front panel 123, the back panel 127, the side panels 131, 135, the corner panels 139, 143, 149, 155, the top end flaps 169, 177, 181, 189, 193, 197, and associated features (e.g., cuts, fold lines, tabs, etc.)

In the illustrated embodiment, the panels 123, 127, 131, 135 can define one or more openings 324 therethrough, for example, to provide product visibility features that can provide a customer with line-of-sight passages into an interior 307 of the tray 305, for example, to inspect food products held therein, and/or to provide ventilation and/or drainage to such food products and/or drainage, for example, for runoff, condensation or other moisture, etc. In addition, the blank 303/tray 305 can be devoid of the leg-forming cuts 138, though it will be understood that these cuts or another leg-forming feature can be provided without departing from the disclosure.

As also shown, the corner panels 139, 143, 149, 155 can be separated from the respective adjacent panels, e.g., so as to be devoid of the respective fold lines 140, 141, 145, 147, 151, 153, 157, 159, though it will be understood that one or more of the corner panels 139, 143, 149, 155 can be foldably connected to one or more respective adjacent panel without departing from the disclosure.

As also shown, an additional longitudinal cut 387 can be provided between the respective pairs of longitudinal cuts 187 along the respective lateral cuts 185, and, similarly, an additional lateral cut 375 can be provided between the respective pairs of lateral cuts 175 along the respective longitudinal cuts 173. As described further herein, the cuts 387, 375 can facilitate the formation of the tray 305 and the insertion of the tabs 201 through the respective cuts to provide additional binding and/or reinforcement of a structural integrity/rigidity of the arrangement of the top end flaps 169, 177, 181, 189, 193, 197.

Figure 6:
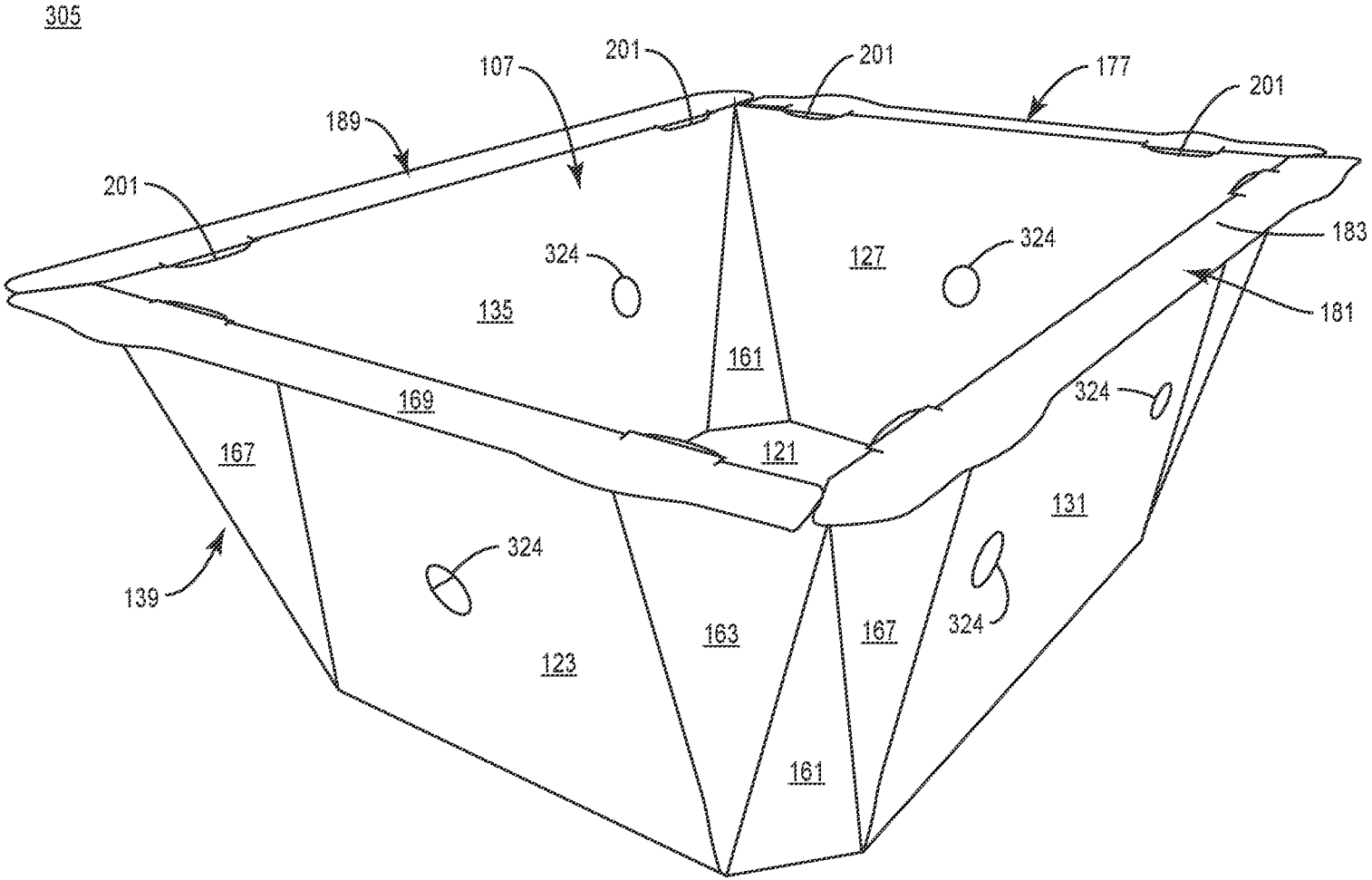
FIG. 6 is a perspective view of a tray formed from the blank of FIG. 5 according to the second exemplary embodiment of the disclosure.

Referring additionally to FIG. 6, the tray 305 can be formed from the blank 303 in a manner similar to that described above with respect to the tray 105. As described above, the presence of the additional cuts 387, 375 can facilitate the insertion of the respective tabs 201 therethrough, and, as shown, can result in a greater region of the tab 201 being exposed externally of the tray 305 so as to enhance the interlocking and engagement of the top end flaps 169, 177, 181, 189, 193, 197. It will be understood that a different arrangement of cuts can be provided without departing from the disclosure.

In this regard, the engagement of the tabs 201 with the respective cuts 173, 175, 375 and cuts 185, 187, 387 provides binding and/or reinforcement of a structural integrity/rigidity of the arrangement of the top end flaps 169, 177, 181, 189, 193, 197/the rim 203, as well as the tray 305 as a whole, e.g., by providing enhanced rigidity that can minimize, inhibit, and/or prevent bending, bowing, flexing, buckling, curling, other deformation, etc. of the rim 203, e.g., in the presence of a lidding film F (FIG. 4) applied thereto.

Figure 7:
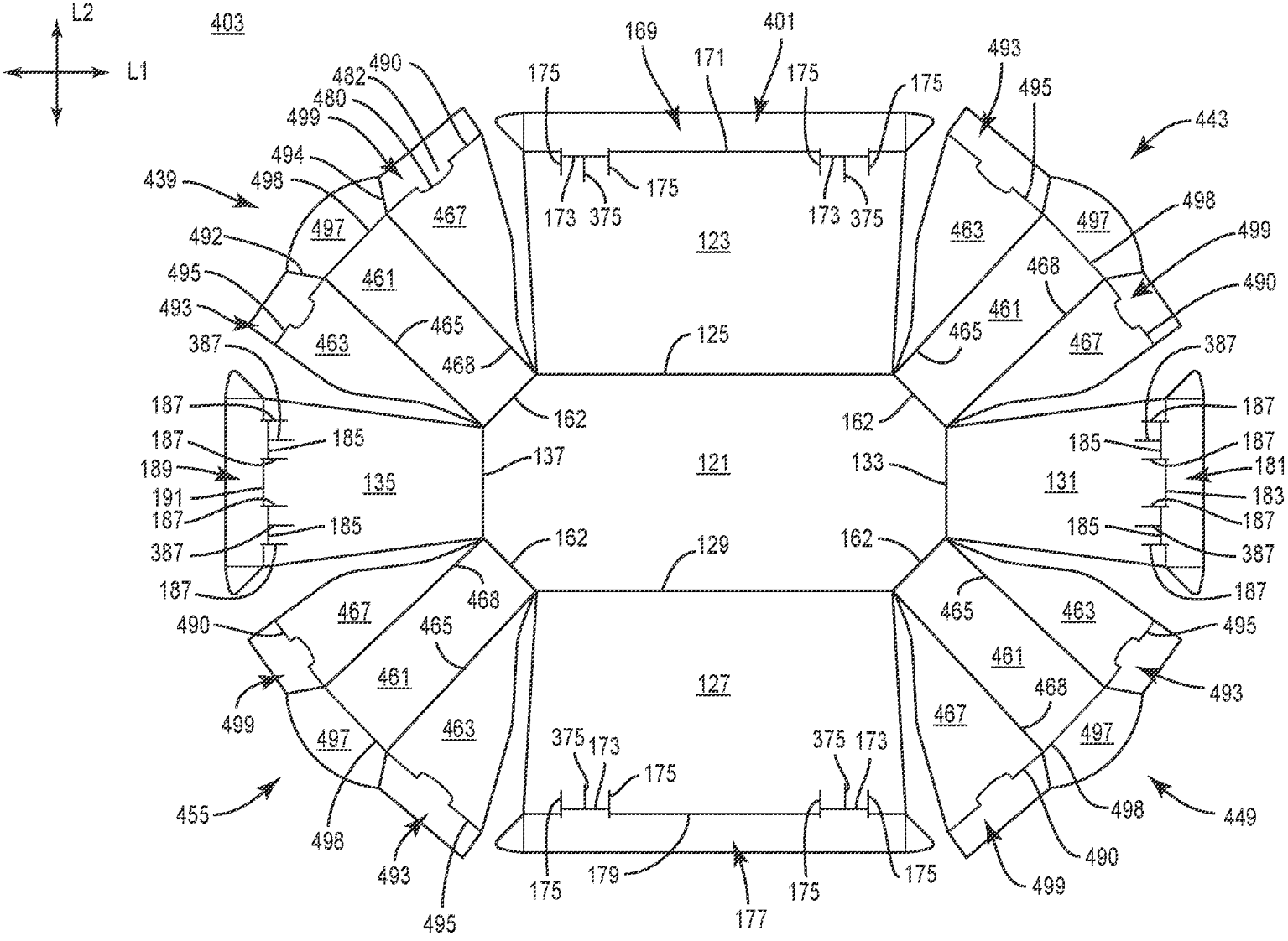
FIG. 7 is a plan view of an exterior surface of a blank used to form a tray according to a third exemplary embodiment of the disclosure.
Figure 7A:
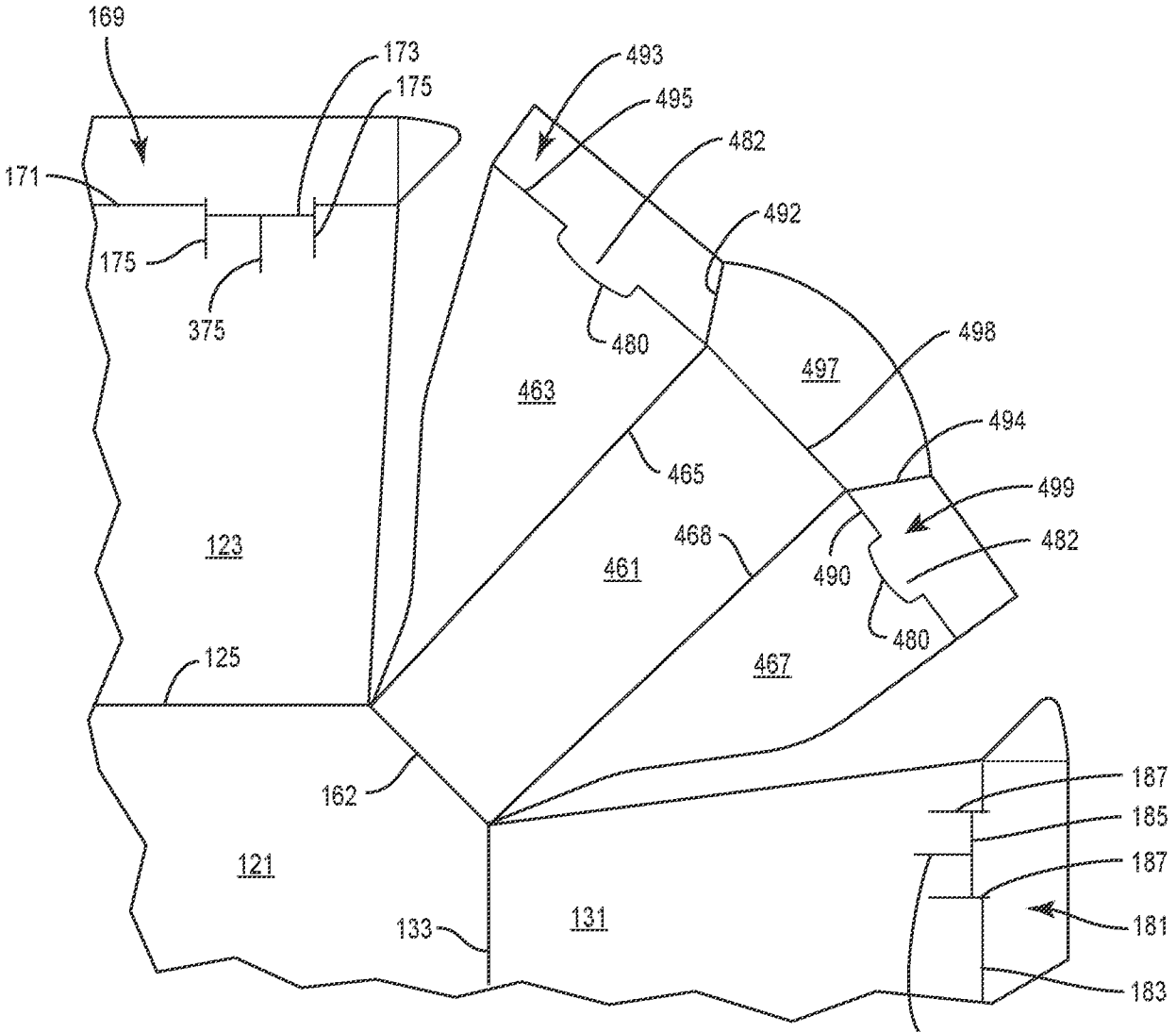
FIG. 7A is an enlarged view of the blank of FIG. 7.

Turning to FIG. 7, an exterior surface 401 of a blank 403 for forming a tray 405 (FIG. 8) according to a third exemplary embodiment of the disclosure is illustrated. The blank 403 and tray 405 can have one or more features similar to those of the blanks 103, 303 and trays 105, 305, described above, and like or similar features are designated with like or similar reference numerals.

As shown, the blank 403 can have the longitudinal axis L1 and the longitudinal axis L2 and can include the bottom panel 121, the front panel 123, the back panel 127, the side panels 131, 135, the top end flaps 169, 177, 181, 189, and associated features (e.g., cuts, fold lines, tabs, etc.)

The blank 403 can have corner panels 439, 443, 449, 455, foldably connected to the bottom panel 121 at the respective oblique fold lines 162. Each corner panel, as shown, includes a central section 461 foldably connected to the bottom panel 121 at a respective oblique fold line 162, a first locking section 463 foldably connected to the central section 461 at an oblique fold line 465, and a second locking section 467 foldably connected to the central locking section 461 at an oblique fold line 468.

As also shown, a first corner section top end flap 493 can be foldably connected to the respective first locking sections 463 of the respective corner panels 439, 443, 449, 455 at respective oblique fold lines 495, a central corner section top end flap 497 can be foldably connected to the respective central section 461 at respective oblique fold lines 498, and a second corner section top end flap 499 can be foldably connected to the respective second locking sections 467 of the respective corner panels 439, 443, 449, 455 at respective oblique fold lines 490. The central corner section top end flap 497 can be foldably connected to the first corner section top end flap 493 and the second corner section top end flap 499 at respective oblique fold lines 492, 494. Furthermore, each of the fold lines 495, 498 can be at least partially interrupted by a respective oblique cut 480 having one or more of curved, straight, and/or angled portions so as to define a tab 482 (broadly, "male locking features", "first tab" or "second tab") extending/protruding from the respective end flaps 493, 497.

As also shown, the corner panels 439, 443, 449, 455 can be separated from the respective adjacent panels, though it will be understood that one or more of the corner panels 439, 443, 449, 455 can be foldably connected to one or more respective adjacent panel without departing from the disclosure.

Figure 8:
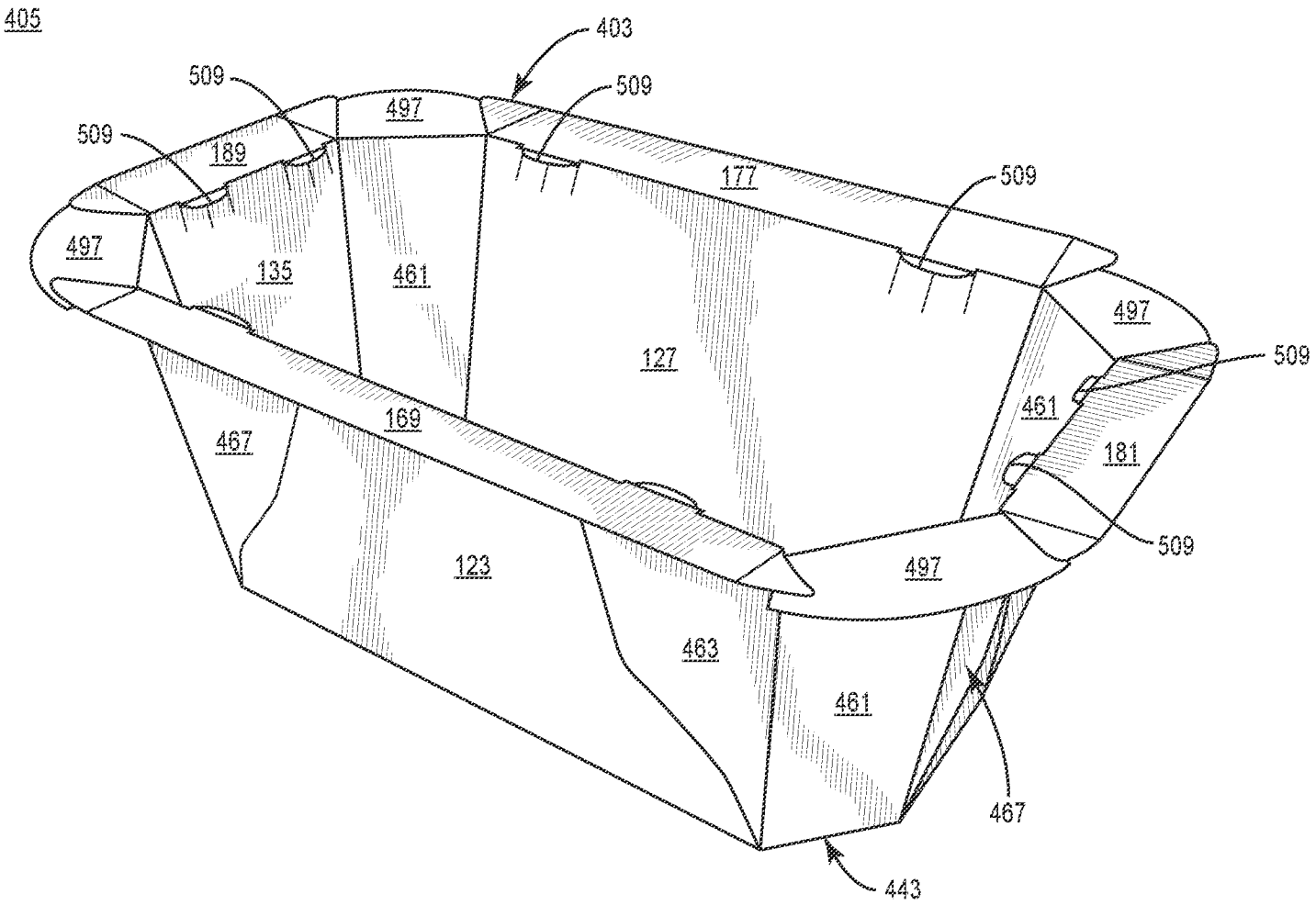
FIG. 8 is a perspective view of a tray formed from the blank of FIG. 7 according to the third exemplary embodiment of the disclosure.

Referring additionally to FIG. 8, the tray 405 can be formed from the blank 403 in a manner similar to that described above with respect to the trays 105, 305. As described above with respect to the tray 305, the presence of the additional cuts 387, 375 can facilitate the insertion of the respective tabs 201 therethrough, and, as shown, can result in a greater region of the tab 201 being exposed externally of the tray 405 so as to enhance the interlocking and engagement of the top end flaps 169, 177, 181, 189, 193, 197. It will be understood that a different arrangement of cuts can be provided without departing from the disclosure.

In this regard, the engagement of the tabs 201 with the respective cuts 173, 175, 375 and cuts 185, 187, 387 provides binding and/or reinforcement of a structural integrity/rigidity of the arrangement of the top end flaps 169, 177, 181, 189, 193, 197/the rim 403, as well as the tray 405 as a whole, e.g., by providing enhanced rigidity that can minimize, inhibit, and/or prevent bending, bowing, flexing, buckling, curling, other deformation, etc. of the rim 403, e.g., in the presence of a lidding film F (FIG. 5) applied thereto.

Figure 9:
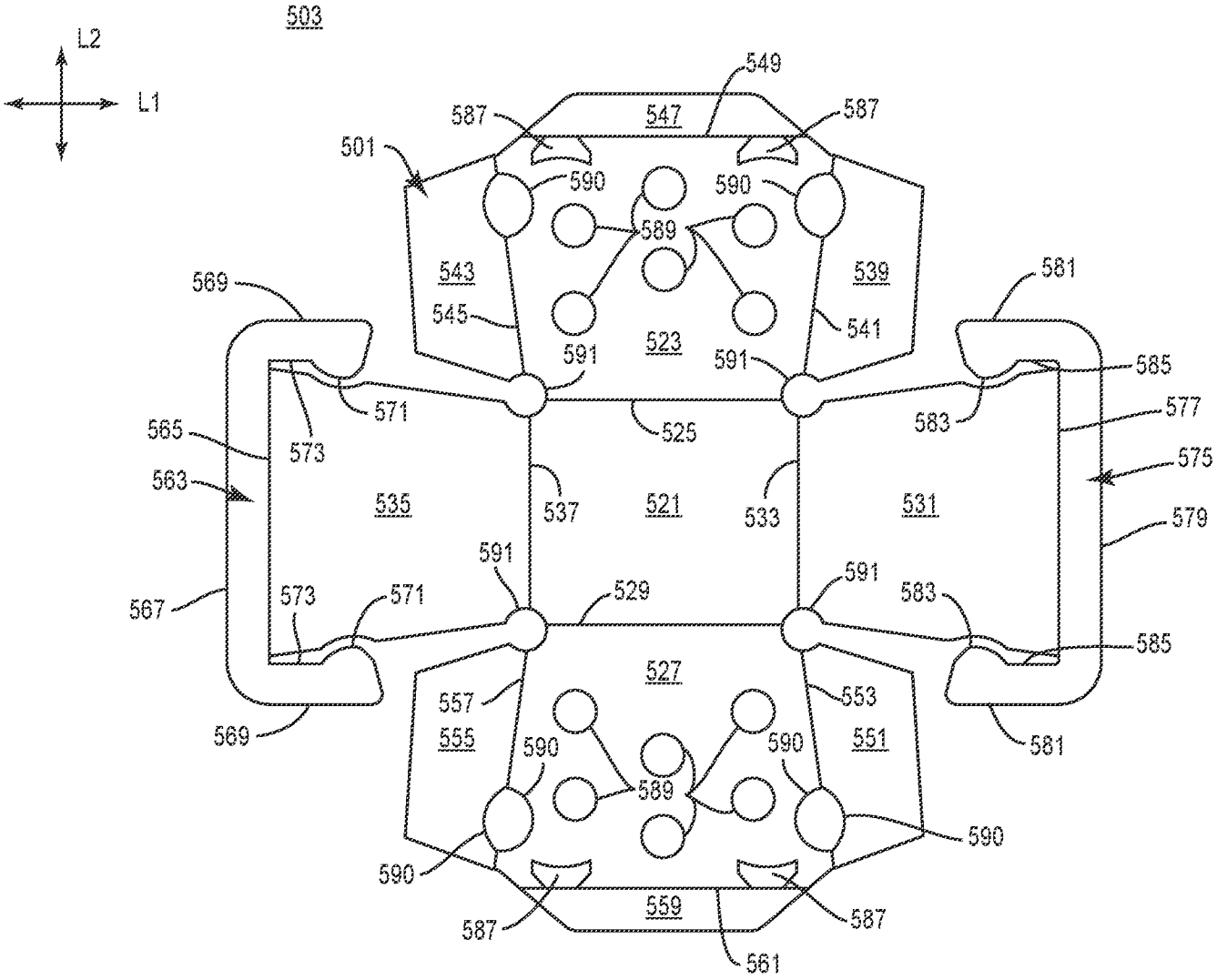
FIG. 9 is a plan view of an exterior surface of a blank used to form a tray according to a fourth exemplary embodiment of the disclosure.

Turning to FIG. 9, a plan view of an exterior surface 501 of a blank 503 used to form a tray 505 (FIG. 11) according to a fifth exemplary embodiment of the disclosure. As shown, the blank 503 has the longitudinal axis L1 and the lateral axis L2, and includes a plurality of panels for extending at least partially around an interior 507 of the tray 505 when the tray 505 is formed from the blank 503.

The panels can include a bottom panel 521, a front panel 523 foldably connected to the bottom panel 521 at a longitudinal fold line 525, a back panel 527 foldably connected to the bottom panel 521 at a longitudinal fold line 529, a first side panel 531 foldably connected to the bottom panel 521 at a lateral fold line 533, and a second side panel 535 foldably connected to the bottom panel 521 at a lateral fold line 537.

The blank 503 can also include a plurality of end flaps foldably connected to respective panels of the plurality of panels of the blank 503. In the illustrated embodiment, the end flaps can include a first front side end flap 539 foldably connected to the front panel 523 at an oblique fold line 541, a second front side end flap 543 foldably connected to the front panel 523 at an oblique fold line 545, and a front top end flap 547 foldably connected to the front panel 523 at a longitudinal fold line 549.

Similarly, a first back side end flap 551 can be foldably connected to the back panel 527 at an oblique fold line 553, a second back side end flap 555 can be foldably connected to the back panel 527 at an oblique fold line 557, and a back top end flap 559 can be foldably connected to the back panel 527 at a longitudinal fold line 561.

A first side top end flap 563 can be foldably connected to the first side panel 531 at a lateral fold line 565, and can include a central portion 567 and a pair of locking portions 569 (broadly, "male locking features", "first locking portion", "second locking portion") extending from opposite ends of the central portion 567. As shown, the locking portions 569 can extend laterally past the free side edges of the first side panel 531, and can extend generally perpendicularly away from the central portion 567, e.g., at least partially longitudinally toward the bottom panel 521. The locking portions 569 can define a locking surface 571 having one or more protruding features (e.g., having curved, straight, and/or angled portions) and positioned opposite a free side edge of the side panel 531 such that a gap 573 is defined therebetween.

Similarly, a first side top end flap 575 can be foldably connected to the second side panel 535 at a lateral fold line 577, and can include a central portion 579 and a pair of locking portions 581 (broadly, "male locking features", "first locking portion", "second locking portion") extending from opposite ends of the central portion 579 and extending at least partially longitudinally toward the bottom panel 521. The locking portions 581 can form a respective locking surface 583 having one or more protruding features and positioned opposite a free side edge of the side panel 535 such that a gap 585 is defined therebetween.

As described further herein, the locking portions 569 of the top end flap 563 and the locking portions 581 of the top end flap 575 can be for at least partial insertion through respective locking openings 587 (broadly, "first locking opening", "second locking opening") in the front panel 523 and the back panel 527. As shown, a pair of the locking openings 587 can be positioned longitudinally spaced apart in the front panel 523 and at least partially interrupting the fold line 549, and a pair of the locking openings 587 can be positioned longitudinally spaced apart in the back panel 527 and at least partially interrupting the fold line 561. One or more of the locking openings 587, as shown, can be defined by one or more curved, angled, and/or straight edges of the respective panels 523, 527.

In this regard, the locking portions 569 of the top end flaps 563, the locking portions 581 of the top end flap 575, and the locking openings 587, together or in various subcombinations, can form locking features of the blank 503/tray 505. As described further herein, the locking features facilitate and maintain a structural integrity of the tray 505, and can at least partially form engagement features of the tray 505.

The blank 503 can also include product visibility features for forming product visibility features of the tray 505. In the illustrated embodiment, each of the front panel 523 and the back panel 527 can include one or more openings 589. As shown, one or more openings 590 can be at least partially positioned in the panels 523, 527 and interrupt a respective fold line 541, 545, 553, 557 so as to at least partially extend into an adjacent end flap. In addition, curved cuts 591 can be formed at least partially along corners of the bottom panel 521, and extend into respective portions of the front panel 523, the back panel 527, the side panels 531, 535, and the side end flaps 539, 543, 551, 555. As described further herein, the product visibility features can provide a customer with line-of-sight passages into the interior 507 of the tray 505, for example, to inspect food products held therein.

Figure 10:
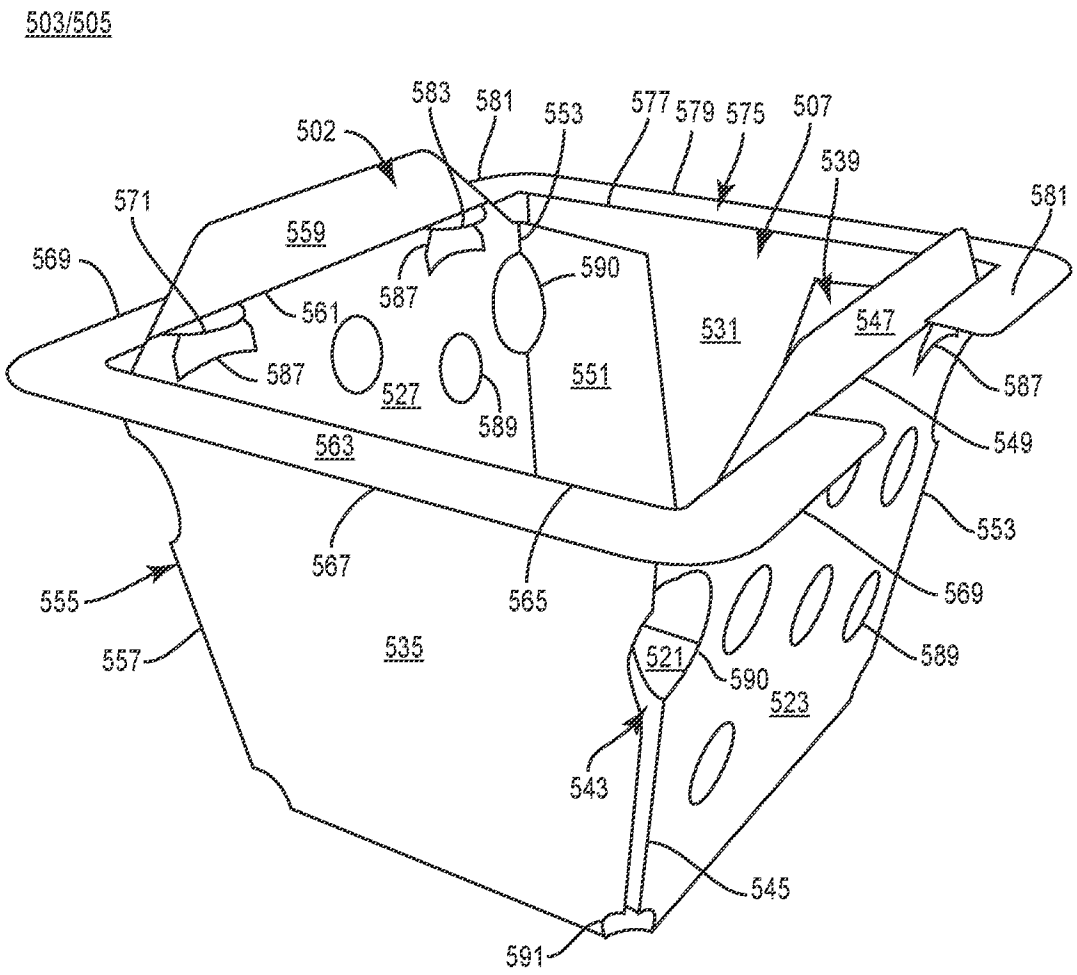
FIG. 10 is a perspective view of a partially folded configuration of a tray formed from the blank of FIG. 9 according to the fourth exemplary embodiment of the disclosure.
Figure 11:
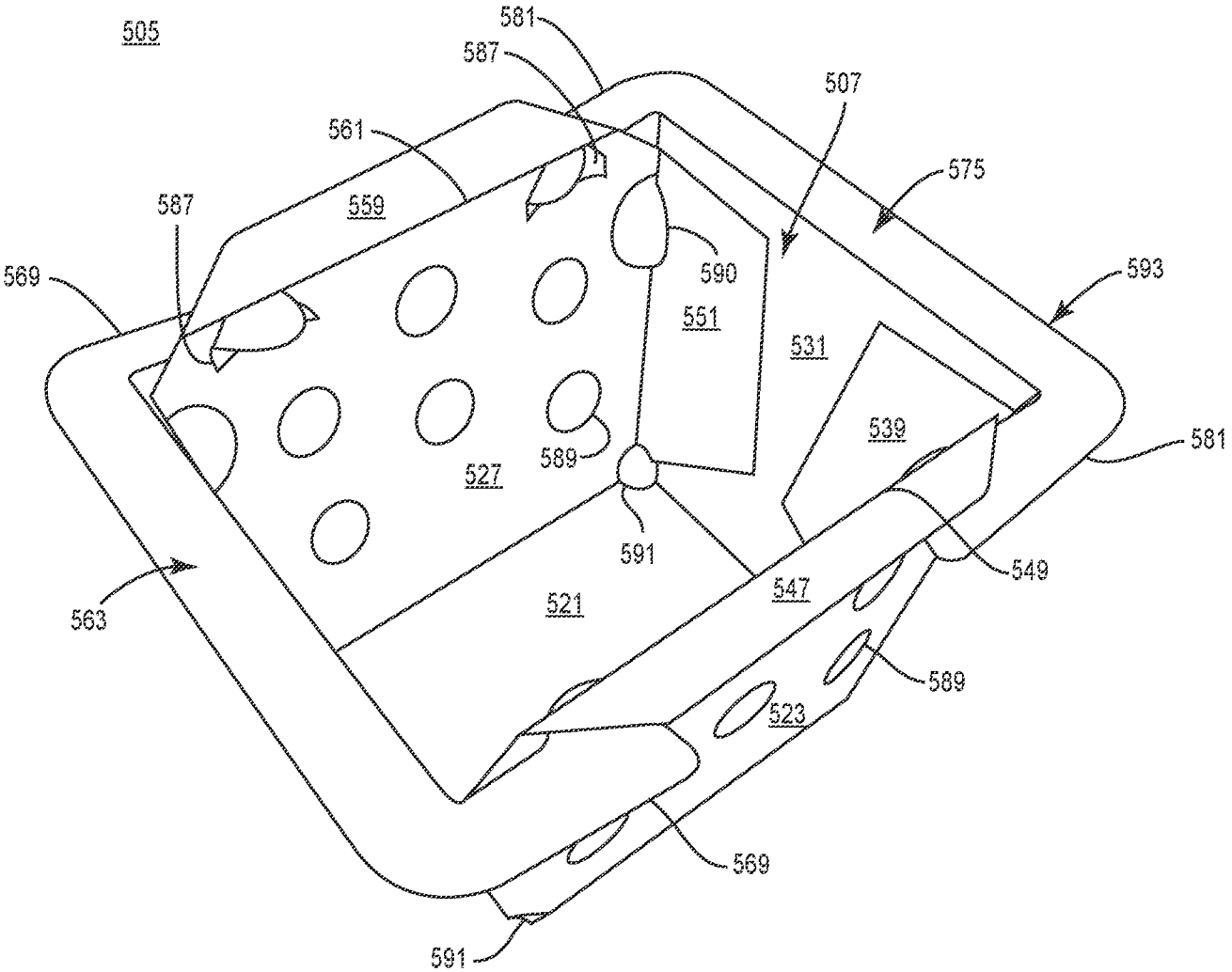
FIG. 11 is a perspective view of a tray formed from the blank of FIG. 9 according to the fourth exemplary embodiment of the disclosure.

Referring additionally to FIGS. 10 and 11, the blank 503 can be inverted such that the exterior surface 501 is positioned on a supporting surface and such that an interior surface of the blank 503 can be positioned facing upwardly, and the front panel 523, the back panel 527, the first side panel 531, and the second side panel 535 can be folded upwardly relative to the bottom panel 521 at the respective fold lines 525, 529, 533, 537.

The front side end flap 539 can be folded at the fold line 541 into at least partial face-to-face contact with the interior surface of the side panel 531, the front side end flap 543 can be folded at the fold line 545 into at least partial face-to-face contact with the interior surface of the side panel 535, the back side end flap 551 can be folded at the fold line 553 into at least partial face-to-face contact with the interior surface of the side panel 531, and the back side end flap 555 can be folded at the fold line 557 into at least partial face-to-face contact with the interior surface of the side panel 535.

The top end flap 563 can be folded at the fold line 565 outwardly from the interior 507 of the tray 505. During such movement of the top end flap 563, the locking portions 569 can be vertically aligned with a respective locking opening 587 in the front panel 523 and a locking opening 587 in the back panel 527. Such positioning and movement of the locking portions 569 of the top end flap 563 can be facilitated by the gap 573 between the locking portions 569 and the side panel 531.

Thereafter, the locking portions 569 can be at least partially received through the respective locking openings 587. Such insertion of the locking portions 569 through the respective locking openings 587 can be facilitated by manual manipulation of the locking portion 569 relative to the central portion 567 of the top end flap 563 and/or a resiliency or bias associated with the material (e.g., paperboard) that forms the top end flap 563. As the locking portions 569 pass through the respective locking openings 587, the respective locking surfaces 571 can engage one or more surfaces of the respective panels 523, 527, e.g., a surface surrounding the respective locking openings 587 and/or an interior surface of the respective panels 523, 527.

Similarly, the top end flap 575 can be folded downwardly at the fold line 577 to vertically align the locking portions 581 with respective locking openings 587 in the front panel 523 and the back panel 527. The locking portions 581 can be at least partially received through the respective locking openings 587 such that the respective locking surfaces 583 can engage one or more surfaces of the respective panels as described above with regard to the locking portions 569.

The top end flap 547 can be folded at the fold line 549 into overlapping/at least partial face-to-face contact with respective portions of the top end flaps 563, 575, and the top end flap 559 can be folded at the fold line 561 into overlapping/at least partial face-to-face contact with respective portions of the top end flaps 563, 575.

In the illustrated embodiment of the tray 505, the panels 523, 527, 531, 535 can extend generally upwardly and obliquely outwardly from the bottom panel 521 such that the tray 505 has a generally tapered configuration, e.g., such that a top opening defined by the upper edges of the panels 523, 527, 531, 535 is larger than the bottom panel 521. Furthermore, the top end flaps 547, 559, 563, 575 are positioned extending generally parallel to the bottom panel 521.

It will be understood that one or more food products, e.g., food products P (FIG. 5) can be dropped, placed, or otherwise positioned in the interior 507 of the tray 505 during or subsequent to the aforementioned steps. In one embodiment, the food products can be tomatoes, such as cherry tomatoes, though one or more of the food products can be a different food product without departing from the disclosure.

The product visibility features of the tray 505 can provide a customer with the ability to at least partially see the food products through the sides of the tray 505, for example, through one or more of the openings 589, 590 or gaps between panels/flaps provided by one or more of the cuts 591. It will be understood that one or more of the openings 589, 590/gaps defined by the cuts 591 can provide ventilation to the food products and/or drainage, for example, for runoff, condensation or other moisture, etc.

Still referring to FIG. 11, engagement features of the tray 505 include the arrangement of the top end flaps 547, 559, 563, 575, and portions thereof. As shown, the folded arrangement of the top end flaps 547, 559, 563, 575 extending outwardly from the respective panels forms a rim 593 and one or more engagement surfaces for being engaged/supported by an element associated with a forming apparatus for the tray 505, for example a machine element such as a grasper, fork, pincer, rail, etc. In one embodiment, the exterior (e.g., downward facing) surface of the top end flaps can present engagement surfaces for being engaged/supported by such a machine element. In other embodiments, engagement surfaces can include any combination of one or more of the exterior, interior (e.g., upward facing), and/or side-facing surfaces of one or more of the top end flaps 547, 559, 563, 575.

The positioning of the top end flaps 547, 559, 563, 575 extending away from the panels of the tray 505, also present a plurality of engagement/support surfaces for engaging/supporting a lidding film such as lidding film F (FIG. 5), e.g., a plastic or other polymeric film, or other covering structure. The lidding film can thus be positioned extending across a top opening of the tray 505 in contact with one or more surfaces of one or more of the top end flaps 547, 559, 563, 575 to cover the interior 507 of the tray 505 and maintain one or more conditions of the food products held therein, e.g., freshness, ripeness, moisture content, etc. It will be understood that the lidding film can minimize, inhibit, and/or prevent the passage of one or more materials into the interior 507 of the tray 505, for example, condensation or other moisture, insects or other pests, dirt, debris, etc. In one embodiment, the tray 505 can be provided together with a lidding film and one or more food products as a package. In one embodiment, the lidding film can be provided as a polymeric layer that at least partially deforms in the presence of a heat source, e.g., a heat sealable film.

Furthermore, the engagement of the locking portions 569 of the top end flap 563 and the locking portions 581 of the top end flap 575 with the respective front panel 523 and back panel 527 provides binding and/or reinforcement of a structural integrity/rigidity of the arrangement of the top end flaps 547, 559, 563, 575/the rim 593, as well as the tray 505 as a whole. For example, the enhanced rigidity provided to the arrangement of the top end flaps 547, 559, 563, 575 via engagement of the locking portions 569, 581 with the respective panels 523, 527 can minimize, inhibit, and/or prevent bending, bowing, flexing, buckling, curling, other deformation, etc. of the rim 593.

In this regard, forces exerted on the rim 593 via tension applied through a lidding film disposed thereon can minimize, inhibit, and/or prevent deformation of the rim 593, e.g., to avoid undesirable product aesthetics, to avoid at least partial disengagement of the lidding film with the rim 593, to maintain a generally planar configuration of the rim 593 for stacking, storage, transport, etc.

It will be understood that one or more of the panels, flaps, and associated features of the blank 503/tray 505 can have a different arrangement or configuration without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the trays, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The term "glue" is intended to encompass all manner of adhesives commonly used to secure tray panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding at least one food product, the tray comprising:

a plurality of panels extending at least partially around an interior of the tray, the plurality of panels comprising a bottom panel, a front panel, a back panel, at least one side panel, and at least one corner panel comprising a first locking section and a second locking section, one of the first locking section and the second locking section at least partially overlapping the at least one side panel and the other of the first locking section and the second locking section at least partially overlapping one of the front panel and the back panel;

a plurality of end flaps foldably connected to a respective panel of the plurality of panels and cooperating to form a rim extending outwardly from the plurality of panels; and locking features comprising at least one male locking feature extending from at least one end flap of the plurality of end flaps, the at least one male locking feature at least partially inserted through at least one female locking feature in a respective panel of the plurality of panels to reinforce the rim.

2. The tray of claim 1, wherein the at least one female locking feature is an at least one cut in a respective panel of the plurality of panels.

3. The tray of claim 2, wherein the at least one male locking feature is an at least one tab extending from the at least one end flap of the plurality of end flaps.

4. The tray of claim 3, wherein the at least one end flap is foldably connected to the at least one corner panel.

5. The tray of claim 4, wherein the at least one corner panel comprises a central section foldably connected to each of the first locking section and the second locking section, the at least one end flap foldably connected to a respective locking section.

6. The tray of claim 5, wherein the at least one cut is formed in the at least one side panel.

7. The tray of claim 5, wherein the at least one cut is formed in one of the front panel and the back panel.

8. The tray of claim 5, wherein the at least one end flap is a first corner section top end flap foldably connected to the first locking section, the plurality of end flaps further comprises a second corner top end flap foldably connected to the second locking section, the at least one tab is a first tab extending from the first corner section top end flap, and the locking features further comprise a second tab extending from the second corner section top end flap.

9. The tray of claim 8, wherein the at least one cut is a first cut in the at least one side panel and the locking features further comprise a second cut in one of the front panel and the back panel.

10. The tray of claim 1, wherein the at least one female locking feature is an at least one locking opening defined in a respective panel of the plurality of panels.

11. The tray of claim 10, wherein the at least one male locking feature is an at least one locking portion extending from the at least one end flap of the plurality of end flaps.

12. The tray of claim 11, wherein the at least one locking portion extends generally perpendicularly away from a central portion of the at least one end flap.

13. The tray of claim 11, wherein the at least one side panel is a first side panel, the plurality of panels further comprises a second side panel, the at least one end flap is a first side top end flap foldably connected to the first side panel, and the plurality of end flaps further comprises a second side top end flap foldably connected to the second side panel, a front top end flap foldably connected to the front panel, and a back top end flap foldably connected to the back panel.

14. The tray of claim 13, wherein each of the front top end flap and the back top end flap overlap respective portions of the first top end flap and the second top end flap.

15. A tray for holding at least one food product, the tray comprising:

a plurality of panels extending at least partially around an interior of the tray, the plurality of panels comprising a bottom panel, a front panel, a back panel, and at least one side panel;

a plurality of end flaps foldably connected to a respective panel of the plurality of panels and cooperating to form a rim extending outwardly from the plurality of panels; and locking features comprising at least one locking portion extending from at least one end flap of the plurality of end flaps, the at least one locking portion at least partially inserted through at least one locking opening defined in a respective panel of the plurality of panels to reinforce the rim, wherein the at least one end flap of the plurality of end flaps is foldably connected to the at least one side panel, the at least one locking portion is a first locking portion extending from the at least one end flap, the locking features further comprise a second locking portion extending from the at least one end flap, wherein the at least one locking opening is a first locking opening in the front panel and at least partially receiving the first locking portion, and the locking features further comprise a second locking opening in the back panel and at least partially receiving the second locking portion.

16. A blank for forming a tray for holding at least one food product, the blank comprising:

a plurality of panels comprising a bottom panel, a front panel, a back panel, at least one side panel, and at least one corner panel comprising a first locking section and a second locking section, one of the first locking section and the second locking section for being positioned at least partially overlapping the at least one side panel when the tray is formed from the blank, and the other of the first locking section and the second locking section for being positioned at least partially overlapping one of the front panel and the back panel when the tray is formed from the blank;

a plurality of end flaps foldably connected to a respective panel of the plurality of panels for cooperating to form a rim extending outwardly from the plurality of panels when the tray is formed from the blank; and locking features comprising at least one male locking feature extending from at least one end flap of the plurality of end flaps, the at least one male locking feature for being at least partially inserted through at least one female locking feature in a respective panel of the plurality of panels to reinforce the rim when the tray is formed from the blank.

17. The blank of claim 16, wherein the at least one female locking feature is an at least one cut in a respective panel of the plurality of panels.

18. The blank of claim 17, wherein the at least one male locking feature is an at least one tab extending from the at least one end flap of the plurality of end flaps.

19. The blank of claim 18, wherein the at least one end flap is foldably connected to the at least one corner panel.

20. The blank of claim 19, wherein the at least one corner panel comprises a central section foldably connected to each of the first locking section and the second locking section, the at least one end flap foldably connected to a respective locking section.

21. The blank of claim 20, wherein the at least one cut is formed in the at least one side panel.

22. The blank of claim 20, wherein the at least one cut is formed in one of the front panel and the back panel.

23. The blank of claim 20, wherein the at least one end flap is a first corner section top end flap foldably connected to the first locking section, the plurality of end flaps further comprises a second corner top end flap foldably connected to the second locking section, the at least one tab is a first tab extending from the first corner section top end flap, and the locking features further comprise a second tab extending from the second corner section top end flap.

24. The blank of claim 23, wherein the at least one cut is a first cut in the at least one side panel and the locking features further comprise a second cut in one of the front panel and the back panel.

25. The blank of claim 16, wherein the at least one female locking feature is an at least one locking opening defined in a respective panel of the plurality of panels.

26. The blank of claim 25, wherein the at least one male locking feature is an at least one locking portion extending from the at least one end flap of the plurality of end flaps.

27. The blank of claim 26, wherein the at least one locking portion extends generally perpendicularly away from a central portion of the at least one end flap.

28. The blank of claim 26, wherein the at least one side panel is a first side panel, the plurality of panels further comprises a second side panel, the at least one end flap is a first side top end flap foldably connected to the first side panel, and the plurality of end flaps further comprises a second side top end flap foldably connected to the second side panel, a front top end flap foldably connected to the front panel, and a back top end flap foldably connected to the back panel.

29. A blank for forming a tray for holding at least one food product, the blank comprising:

a plurality of panels comprising a bottom panel, a front panel, a back panel, and at least one side panel;

a plurality of end flaps foldably connected to a respective panel of the plurality of panels for cooperating to form a rim extending outwardly from the plurality of panels when the tray is formed from the blank; and locking features comprising at least one locking portion extending from at least one end flap of the plurality of end flaps, the at least one locking portion for being at least partially inserted through at least one locking opening defined in a respective panel of the plurality of panels to reinforce the rim when the tray is formed from the blank, wherein the at least one end flap of the plurality of end flaps is foldably connected to the at least one side panel, the at least one locking portion is a first locking portion extending from the at least one end flap, the locking features further comprise a second locking portion extending from the at least one end flap, wherein the at least one locking opening is a first locking opening in the front panel for at least partially receiving the first locking portion when the tray is formed from the blank, and the locking features further comprise a second locking opening in the back panel for at least partially receiving the second locking portion when the tray is formed from the blank.

30. A method of forming a tray for holding at least one food product, the method comprising:

obtaining a blank comprising a plurality of panels comprising a bottom panel, a front panel, a back panel, at least one side panel, and at least one corner panel, the at least one corner panel comprising a first locking section and a second locking section, the blank further comprising a plurality of end flaps foldably connected to a respective panel of the plurality of panels, the blank further comprising locking features comprising at least one male locking feature extending from at least one end flap of the plurality of end flaps and at least one female locking feature in a respective panel of the plurality of panels;

folding the plurality of panels at least partially around an interior of the tray such that the at least one corner panel is positioned with one of the first locking section and the second locking section at least partially overlapping the at least one side panel and with the other of the first locking section and the second locking section at least partially overlapping one of the front panel and the back panel;

positioning the plurality of end flaps to form a rim extending outwardly from the plurality of panels; and inserting the at least one male locking feature at least through the at least one female locking feature to reinforce the rim.

31. The method of claim 30, wherein the at least one female locking feature is an at least one cut in a respective panel of the plurality of panels.

32. The method of claim 31, wherein the at least one male locking feature is an at least one tab extending from the at least one end flap of the plurality of end flaps.

33. The method of claim 32, wherein the at least one end flap is foldably connected to the at least one corner panel.

34. The method of claim 33, wherein the at least one corner panel comprises a central section foldably connected to each of the first locking section and the second locking section, the at least one end flap foldably connected to a respective locking section.

35. The method of claim 34, wherein the at least one cut is formed in the at least one side panel.

36. The method of claim 34, wherein the at least one cut is formed in one of the front panel and the back panel.

37. The method of claim 34, wherein the at least one end flap is a first corner section top end flap foldably connected to the first locking section, the plurality of end flaps further comprises a second corner top end flap foldably connected to the second locking section, the at least one tab is a first tab extending from the first corner section top end flap, and the locking features further comprise a second tab extending from the second corner section top end flap.

38. The method of claim 37, wherein the at least one cut is a first cut in the at least one side panel and the locking features further comprise a second cut in one of the front panel and the back panel.

39. The method of claim 30, wherein the at least one female locking feature is an at least one locking opening defined in a respective panel of the plurality of panels.

40. The method of claim 39, wherein the at least one male locking feature is an at least one locking portion extending from the at least one end flap of the plurality of end flaps.

41. The method of claim 40, wherein the at least one locking portion extends generally perpendicularly away from a central portion of the at least one end flap.

42. The method of claim 40, wherein the at least one side panel is a first side panel, the plurality of panels further comprises a second side panel, the at least one end flap is a first side top end flap foldably connected to the first side panel, and the plurality of end flaps further comprises a second side top end flap foldably connected to the second side panel, a front top end flap foldably connected to the front panel, and a back top end flap foldably connected to the back panel.

43. The method of claim 42, wherein folding the plurality of end flaps comprises positioning each of the front top end flap and the back top end flap to overlap respective portions of the first top end flap and the second top end flap.

44. A method of forming a tray for holding at least one food product, the method comprising:

obtaining a blank comprising a plurality of panels comprising a bottom panel, a front panel, a back panel, and at least one side panel, the blank further comprising a plurality of end flaps foldably connected to a respective panel of the plurality of panels, the blank further comprising locking features comprising at least one locking portion extending from at least one end flap of the plurality of end flaps and at least one locking opening defined in a respective panel of the plurality of panels, wherein the at least one end flap of the plurality of end flaps is foldably connected to the at least one side panel, the at least one locking portion is a first locking portion extending from the at least one end flap, the locking features further comprise a second locking portion extending from the at least one end flap, wherein the at least one locking opening is a first locking opening in the front panel and the locking features further comprise a second locking opening in the back panel;

folding the plurality of panels at least partially around an interior of the tray;

positioning the plurality of end flaps to form a rim extending outwardly from the plurality of panels;

at least partially inserting the first locking portion through the first locking opening to reinforce the rim; and at least partially inserting the second locking portion through the second locking opening to reinforce the rim.

* * * * *